US007611173B2

(12) United States Patent
Helton et al.

(10) Patent No.: US 7,611,173 B2
(45) Date of Patent: Nov. 3, 2009

(54) LATCH SYSTEM KIT AND METHOD OF MAKING A LATCH SYSTEM

(75) Inventors: Craig J. Helton, Decorah, IA (US); Ricci L. Marzolf, New Hampton, IA (US)

(73) Assignee: Tri/Mark Corporation, New Hampton, IA (US)

( * ) Notice: Subject to any disclaimer, the term of this patent is extended or adjusted under 35 U.S.C. 154(b) by 323 days.

(21) Appl. No.: 11/488,485

(22) Filed: Jul. 18, 2006

(65) Prior Publication Data

US 2008/0018116 A1 Jan. 24, 2008

(51) Int. Cl.
*E05C 1/12* (2006.01)
*E05C 3/06* (2006.01)

(52) U.S. Cl. ..... 292/173; 292/137; 292/146; 292/150; 292/203; 292/210; 292/216; 292/DIG. 31

(58) Field of Classification Search ..... 292/173, 292/216, DIG. 31, 137, 146, 150, 203, 210
See application file for complete search history.

(56) References Cited

U.S. PATENT DOCUMENTS 4,335,595 A * 6/1982 Swan et al. ..... 70/149
4,826,682 A 5/1989 Sakharova
4,996,053 A 2/1991 Hatcher
5,046,340 A * 9/1991 Weinerman et al. ..... 70/208
5,058,937 A 10/1991 Miehe et al.
5,096,710 A 3/1992 Minagawa et al.
5,127,686 A * 7/1992 Gleason et al. ..... 292/216
5,223,270 A 6/1993 Jones
5,273,761 A 12/1993 Kim et al.
5,299,844 A 4/1994 Gleason
5,439,260 A 8/1995 Weinerman et al.

(Continued)

FOREIGN PATENT DOCUMENTS

BE 755598 A 9/1970

(Continued)

OTHER PUBLICATIONS

Cardoza, Ron "Laboratory Evaluation of Niban® Granular Bait in the control of Pavement Ants," Bio Study No. 134-02, pp. 1-9, 2003

(Continued)

*Primary Examiner*—Carlos Lugo
(74) *Attorney, Agent, or Firm*—Wood, Phillips, Katz, Clark & Mortimer

(57) ABSTRACT

A kit for selectively constructing a system for releasably maintaining a movable closure element in a predetermined position relative to a frame upon which the closure element is movably mounted. The kit includes a base assembly, a first mechanism that is operably attachable to the base assembly to define a first system having a first configuration that is operable in a first manner, and a second mechanism that is operably attachable to the base assembly to define a second system having a second configuration that is operable in a second manner that is different than the first manner. The first and second mechanisms are interchangeably operably attachable to the base assembly, one in place of the other, to allow a selection to be made by an assembler as to a desired configuration and manner of operation of a system.

35 Claims, 31 Drawing Sheets

U.S. PATENT DOCUMENTS

| | | | | |
|---|---|---|---|---|
| 5,564,295 | A | 10/1996 | Weinerman et al. | |
| 5,586,458 | A | 12/1996 | Weinerman et al. | |
| 5,606,882 | A * | 3/1997 | Larsen et al. | 70/369 |
| 5,611,224 | A | 3/1997 | Weinerman et al. | |
| 5,665,370 | A | 9/1997 | Gehret et al. | |
| 5,676,961 | A | 10/1997 | Wolfe et al. | |
| 5,705,176 | A | 1/1998 | Stapleton et al. | |
| D390,443 | S | 2/1998 | Zenner | |
| 5,820,855 | A | 10/1998 | Barcay et al. | |
| 5,885,606 | A | 3/1999 | Kawada | |
| 5,927,773 | A | 7/1999 | Larsen et al. | |
| 5,939,061 | A | 8/1999 | Vail et al. | |
| 5,983,682 | A * | 11/1999 | Parikh | 70/208 |
| 6,409,234 | B1 * | 6/2002 | Larsen et al. | 292/173 |
| 6,547,290 | B1 | 4/2003 | Zenner et al. | |
| 6,604,393 | B2 * | 8/2003 | Larsen et al. | 70/208 |
| 7,309,087 | B2 * | 12/2007 | Lane et al. | 292/216 |
| 2006/0006664 | A1 | 1/2006 | Pickar | |

FOREIGN PATENT DOCUMENTS

| | | |
|---|---|---|
| DE | 2431595 | 1/1976 |
| GB | 2411204 | 8/2005 |
| JP | 48033019 A | 5/1973 |
| JP | 50135234 A | 10/1975 |

OTHER PUBLICATIONS

Cardoza, Ron "Laboratory Evaluation of Niban® Granular in the control of Southern Fire Ants," Bio Study No. 147-02, pp. 1-13, 2003.
Cardoza, Ron "Laboratory Evaluation of Niban® Granular Bait in the control of Argentine Ants," Bio Study No. 252-02, pp. 1-8, 2003.

* cited by examiner

FIG. 15
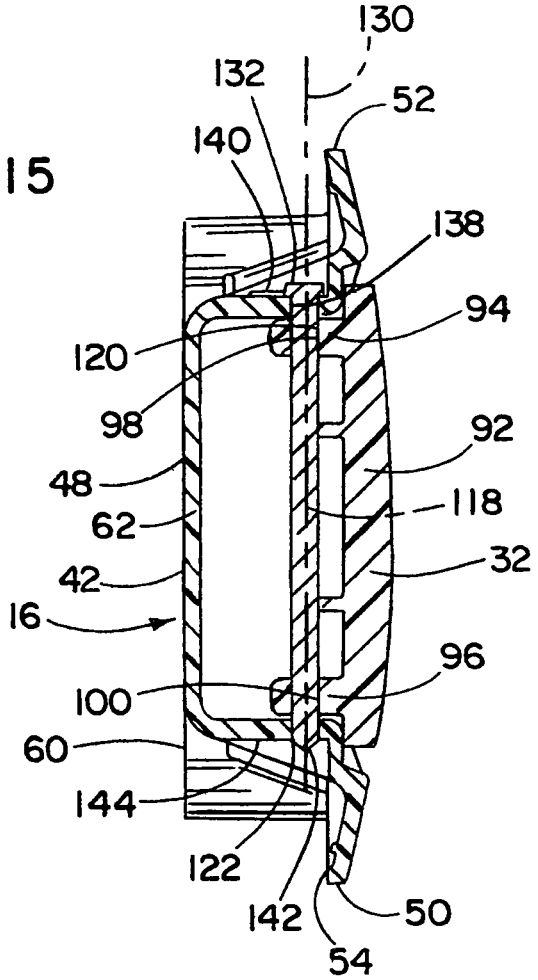
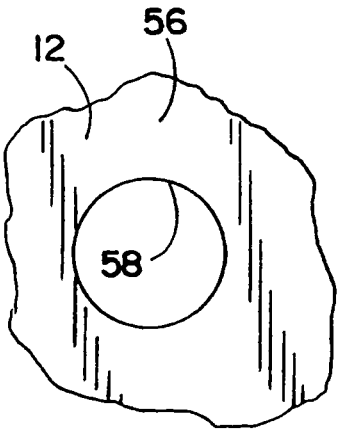
FIG. 16
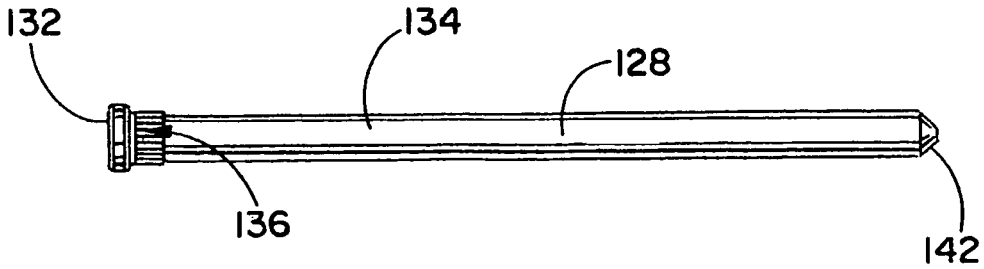
FIG. 17

LATCH SYSTEM KIT AND METHOD OF MAKING A LATCH SYSTEM

BACKGROUND OF THE INVENTION

1. Field of the Invention

This invention relates to latch systems and, more particularly, to a kit from which latch systems with different configurations can be made using interchangeable components. The invention is also directed to a method of making such latch systems.

2. Background Art

Latch systems are used in many diverse environments and for many different applications within those environments. As just some examples, latch systems are used in association with closure elements on on- and off-road vehicles, recreational vehicles, containers in static environments, etc. These latch systems are used in residential, commercial and industrial environments.

These latch systems have in common that they utilize: a) an actuating assembly that is operated by a user and typically mounted on the closure element; and b) a latch assembly that is changeable from a latched state into a release state through operation of the actuating assembly. In the latched state, the closure element is maintained in a predetermined position relative to a supporting structure therefor. In the release state, the closure element is allowed to move from the predetermined position into another position.

The nature of the actuating and latch assemblies varies greatly, based upon need and/or preference. For example, from the standpoint of the actuating assembly, it is common to use pivotable paddle operators with different configurations. As one example, a flat paddle is commonly used that can be grasped by the fingers of a user and pivoted so as to change the state of an associated latch assembly. As an alternative to this flat paddle, it is known to use bail-type paddle operators with an opening through which a user's fingers can be directed to grasp a portion thereof to facilitate repositioning.

For the latch assemblies, it is known to use a bolt that is translatable through the actuating assemblies from a latched position into a release position. As an alternative to a latch bolt, some systems utilize one or more pivotable rotors that cooperate with a strike element on a support for a closure element so as to maintain the closure element in the predetermined position. Through the actuating assembly, the rotor(s) is caused to be repositioned so as to change the latch assembly from the latched state into the release state.

It is also known to interconnect actuating assemblies to a remote latch assembly for indirect operation. This may be accomplished through links, cables, or the like.

Additionally, end users may have specific requirements for keying their systems.

With the many different actuating and latch assemblies and keying alternatives available, a manufacturer of these systems may be called upon to offer a multitude of different options to its users. Heretofore, systems have been custom designed and made available on a case-by-case basis. While this is a workable approach, there are a number of inherent drawbacks associated with such custom design and manufacture.

First and foremost, there are inherent inefficiencies associated with customization. While some minor components are interchangeable from one system to the next, certain major components must be custom engineered and manufactured for each order. The higher costs of engineering must be either absorbed by the manufacturer, so as to reduce profit margin, or passed on to the purchaser.

In addition to requiring specialized parts, a particular system may also require a dedicated line for assembling some or all of the components thereof. Efficiency in manufacture may thus be appreciably reduced. At the same time, certain facilities may not be equipped to practically produce the number of different products that are called for. Space and personnel limitations may cause a manufacturer to turn down otherwise potentially lucrative orders. As an alternative, a purchaser may opt to use a manufacturer that can make a product that will meet needs but is not optimal in configuration.

From the manufacturer's standpoint, offering a wide range of stock items creates a number of additional problems. First of all, the products must be separately manufactured and stored based upon anticipated demand for each. Projecting consumer demand is not an exact science and, as a result, manufacturers may be left with excess products of one type and a shortage of another that is in greater demand. To avoid delay in deliveries, excess of each particular type may be kept on hand. This is often not economically feasible given that substantial space may be required and excess inventory may be carried for long periods of time.

Ideally, latch systems of different configuration would be made available to consumers on demand without the high cost of customized design and production.

SUMMARY OF THE INVENTION

In one form, the invention is directed to a kit for selectively constructing a system for releasably maintaining a movable closure element in a predetermined position relative to a frame upon which the closure element is movably mounted. The kit includes a base assembly, a first mechanism that is operably attachable to the base assembly to define a first system having a first configuration that is operable in a first manner, and a second mechanism that is operably attachable to the base assembly to define a second system having a second configuration that is operable in a second manner that is different than the first manner. The first and second mechanisms are interchangeably operably attachable to the base assembly, one in place of the other, to allow a selection to be made by an assembler as to a desired configuration and manner of operation of a system.

The kit may be provided in combination with a movable closure element upon which the system is operably mounted and a frame to which the movable closure element is mounted for guided movement between a first predetermined position and a second position.

The first and second mechanisms each has a first state, in which they releasably maintain the movable closure element in the first predetermined position. The first and second mechanisms each has a second state wherein the movable closure element is movable from the first predetermined position into the second position. First and second operating assemblies respectively have first and second operating handles that are each graspable by a user and movable relative to the base assembly from a normal position to a release position to thereby change the respective first and second mechanisms from the first state into the second state. The first and second handles have a different configuration to be graspable in different manners to be repositioned by an operator from their normal into their release positions.

In one form, the first and second operating handles are each pivotable between their normal and release positions.

In one form, the first mechanism has at least one rotor that pivots around an axis as the first mechanism is changed between its first and second states. The at least one rotor engages a part on the frame to maintain the movable closure element in the first predetermined position. The second mechanism has a bolt that is translated substantially in a line as the first mechanism is changed between its first and second states. The bolt engages a part on the frame to maintain the movable closure element in the first predetermined position.

In one form, the first and second mechanisms are respectively in the form of first and second modules that are each selectively operably attachable, one in place of the other as a unit, to the base assembly.

In one form, the base assembly has a substantially flat mounting surface. The first mechanism has a first mounting plate with a first flat surface that is placed facially against the flat mounting surface with the first mechanism operably attached to the base assembly. The second mechanism has a second mounting plate with a second flat surface that is placed facially against the flat mounting surface with the second mechanism operably attached to the base assembly.

In one form, the base assembly is in the form of a cup-shaped housing with a front and back and the flat mounting surface is at the back of the cup-shaped housing. The cup-shaped housing has pre-formed bores. The first mounting plate has pre-formed bores alignable with the pre-formed bores in the cup-shaped housing to receive fasteners that maintain the first mechanism operably attached to the base assembly. The second mounting plate has pre-formed bores alignable with the pre-formed bores in the cup-shaped housing to receive fasteners that maintain the second mechanism operably attached to the base assembly.

In one form, the base assembly has an associated actuating assembly with an actuating component that is translated from a retracted position into an extended position to thereby change the first and second mechanisms from their first states into their second states.

In one form, the first mechanism has a pivoting operating arm that is repositionable by the actuating component as the actuating component is changed from the retracted position into the extended position to thereby cause the at least one rotor to pivot around the axis. The actuating component engages the bolt on the second operating mechanism and cams the bolt so as to move the bolt along the line as the actuating component is changed from the retracted position into the extended position.

In one form, the first mechanism has a housing remote from the base assembly upon which the at least one rotor is mounted and there is a linkage connecting between the base assembly and remote housing.

In one form, the first mechanism has a first mounting plate having pre-formed bores that are alignable with a first set of pre-formed bores in the base assembly to accept fasteners that maintain the first mechanism operably attached to the base assembly.

In one form, the linkage is in the form of a bell crank between the base assembly and the remote housing.

The second mechanism may include a second mounting plate having pre-formed bores that are alignable with a second set of pre-formed bores in the base assembly that is different than the first set of pre-formed bores to accept fasteners that maintain the second mechanism operably attached to the base assembly.

In one form, the first handle is in the form of a graspable bail and the second handle is in the form of a flat, graspable paddle.

The base assembly may be made from non-metal material.

In one form, the base assembly is in the form of a cup-shaped housing with a front and back, the housing has a body with a periphery having an effective diameter and an outturned flange on the body defining a rearwardly facing mounting surface. The base assembly and operably attached first or second mechanism is movable as a unit from a fully separated state through a mounting opening in the movable closure element to place the rearwardly facing mounting surface facially against a surface on the movable closure element.

In one form, the unit can be moved by guiding the rearwardly facing mounting surface against the surface on the movable closure element to thereby change an angular orientation of the unit relative to the movable closure element.

The kit may further include a plurality of different, keyed locking cylinders that can be selectively installed on the base assembly to selectively prevent operation of the first and second mechanisms.

The outturned flange may have a peripheral outer edge that is substantially round.

The base assembly may have a non-handed configuration.

In one form, the base assembly has a front and back and the actuating component is translated between the retracted and extended positions in a front-to-back/back-to-front direction.

The invention is further directed to a method of constructing a system for releasably maintaining a movable closure element in a predetermined position relative to a frame upon which the closure element is movably mounted. The method may include the steps of: providing a base assembly; and providing a plurality of components that can be interchangeably mounted on the base assembly, including at least first and second mechanisms that are selectively operably attachable, one in place of the other, to respectively define first and second systems that are operable in different manners by an operator.

The step of providing a plurality of components may involve providing a first mechanism consisting of a first module with at least one pivotable rotor that is engageable with a part on a frame upon which the movable closure element is mounted, and providing a second mechanism in the form of a second module with a bolt that is translatable substantially along a line and engageable with a part on a frame upon which the movable closure element is mounted.

The step of providing a plurality of components may involve providing a first mechanism with a first handle that is pivotable relative to the base assembly and graspable in a first manner, and providing a second mechanism with a second handle that is pivotable relative to the base assembly and graspable in a second manner that is different than the first manner.

The step of operably attaching the first module to the base assembly may involve using a plurality of fasteners directed into a first set of pre-formed bores in the base assembly.

The method may further include the step of operably attaching the second module to the base assembly in place of the first module using a plurality of fasteners directed into a second set of pre-formed bores in the base assembly that is different than the first set of pre-formed bores in the base assembly.

The step of providing a plurality of components may involve providing a first mechanism comprising a housing remote from the base assembly with at least one pivotable rotor that is engageable with a part on a frame, upon which the movable closure element is mounted, and a linkage between the housing and the base assembly.

The step of providing a linkage may involve providing a linkage in the form of a bell crank.

In one form, the step of providing a plurality of components involves providing a plurality of different keyed lock cylinders and selectively installing one of the keyed lock cylinders on the base assembly.

The step of providing a base assembly may involve providing a base assembly with a cup-shaped housing.

The step of providing a base assembly may involve providing an actuating assembly with a movable actuating component that directly interacts with the first and second mechanisms.

The step of providing an actuating assembly may involve providing an actuating assembly with an actuating component that directly interacts with the first and second mechanisms and is movable in substantially a linear path.

The method may further include the steps of providing a movable closure element and operably mounting the base assembly and one of the first and second mechanisms as a unit to the movable closure element.

The step of operably mounting the unit to the movable closure element may involve moving the unit guidingly against the movable closure element to change an angular relationship between the unit and the movable closure element.

BRIEF DESCRIPTION OF THE DRAWINGS

FIG. 15 is a cross-sectional view of the components taken along lines 15-15 of FIG. 12;

FIG. 16 is a reduced, fragmentary, elevation view of the closure element in FIG. 2 and showing an opening for receiving the components in FIGS. 10-15;

FIG. 17 is an enlarged, elevation view of a pin/axle used to pivotably mount the operating handles shown in FIG. 10;

DETAILED DESCRIPTION OF THE DRAWINGS

Figure 1:
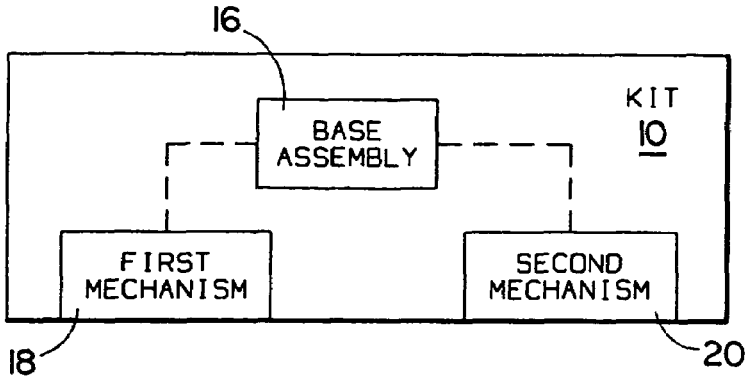
FIG. 1 is a schematic representation of a kit, according to the invention, for selectively constructing a system to releasably maintain a movable closure element in a predetermined position and including a base assembly with selectively interchangeable first and second mechanisms.
Figure 2:
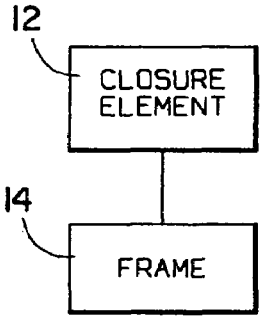
FIG. 2 is a schematic representation of a closure element, upon which the base assembly and selected mechanism of FIG. 1 can be utilized.

In FIG. 1, a kit, according to the invention, is shown at 10 for selectively constructing a system that can be used, for example, on a closure element 12, as shown in FIG. 2, that is guidingly movable relative to a frame 14. The kit 10 consists of a base assembly 16 and first and second latching mechanisms 18, 20, respectively.

Figure 3:
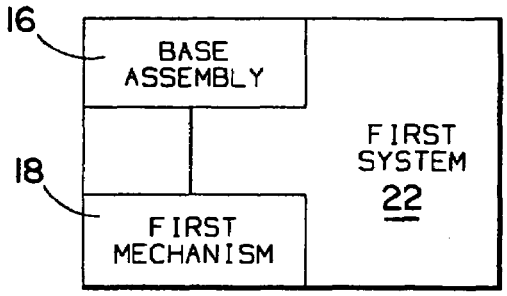
FIG. 3 is a schematic representation of one combination of a base assembly and first mechanism to produce a first system.

As shown in FIG. 3, the first mechanism 18 is operably attachable to the base assembly 16 to define a first system 22 having a first configuration that is operable in a first manner.

Figure 4:
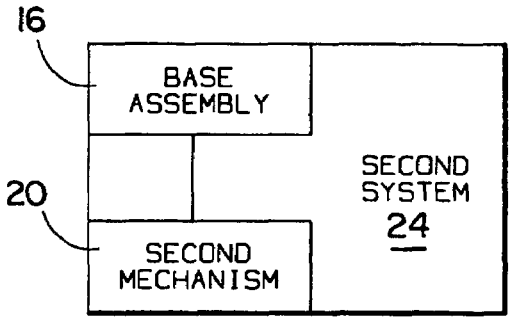
FIG. 4 is a schematic representation as in FIG. 3 to produce a different, second system.

As shown in FIG. 4, the second mechanism 20 is operably attachable to the base assembly 16 to define a second system 24 having a second configuration that is operable in a second manner that is different from the first manner.

The first and second mechanisms 18, 20 are interchangeably operably attachable to the base assembly 16, one in place of the other, to allow a selection to be made by an assembler as to a desired configuration and manner of operation for a system.

Figure 5:
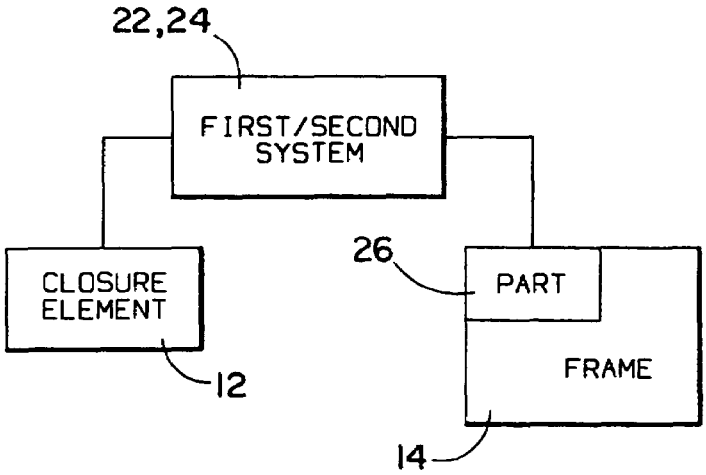
FIG. 5 is a schematic representation of a closure element, to which one of the first and second systems is operatively connected, and in relationship to a frame relative to which the closure element is movable.

As shown in FIG. 5, the selected first/second system 22, 24 is operably mounted to the closure element 12 and cooperates with a part 26 on the frame 14 to releasably maintain the movable closure element 12 in a predetermined first position relative to the frame 14.

The first and second mechanisms 18, 20 each has a first state wherein they releasably maintain the movable closure element 12 in the predetermined first position. The first and second mechanisms 18, 20 each has a second state, wherein the movable closure element 12 is movable from the predetermined first position into a second position.

Typically, the predetermined first position will be a closed/latched position, with the second position being an open/release position. However, this is not a requirement. In either case, the closure element 12 is typically guidingly moved relative to the frame 14 between the predetermined first and second positions.

Figure 6:
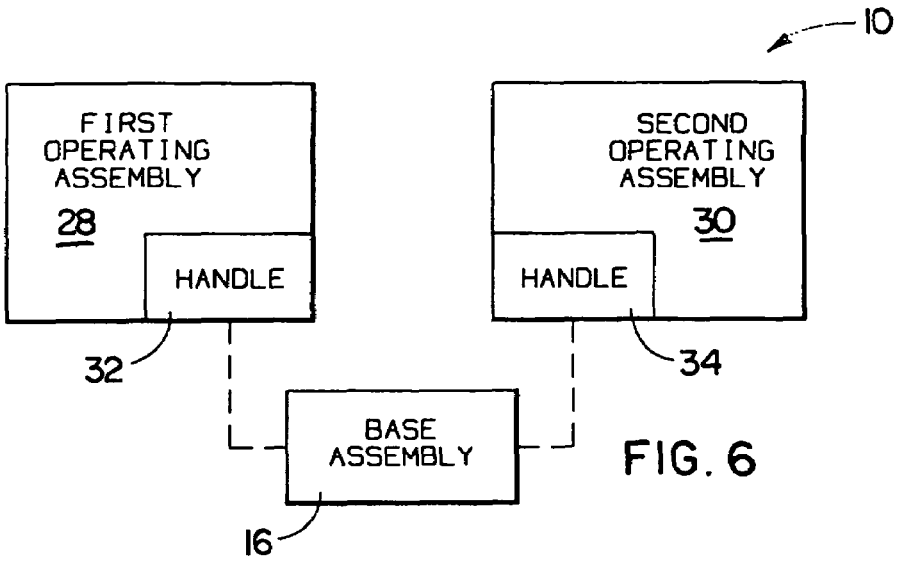
FIG. 6 is a schematic representation showing first and second operating assemblies usable selectively, one in place of the other, on the base assembly, and having different handles thereon.

As shown in FIG. 6, the kit 10, or a modified form thereof, may include first and second operating assemblies 28, 30, that are interchangeably operably attachable, one in place of the other, to the base assembly 16. The first and second operating assemblies 28, 30 may be operable in different manners and/or may have associated elements, such as handles 32, 34, respectively, which have a different shape and/or are operable in a different manner. It should be understood that the invention contemplates interchangeability of different types of operating assemblies 28, 30, whether or not one or both of the operating assemblies 28, 30 has a handle 32, 34.

Figure 7:
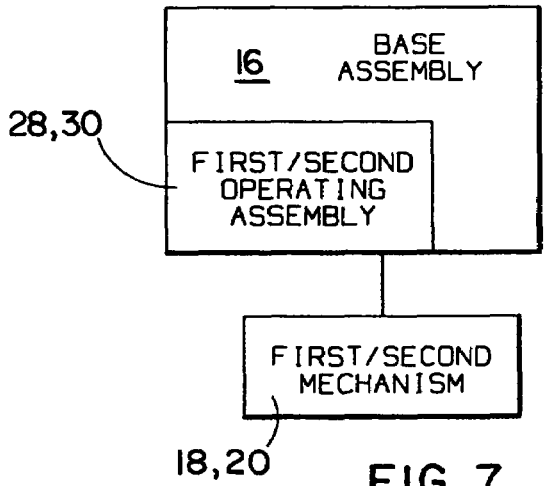
FIG. 7 is a schematic representation of a combination of the base assembly, to which first and second operating assemblies and first and second mechanisms are selectively operatively connected.
Figure 8:
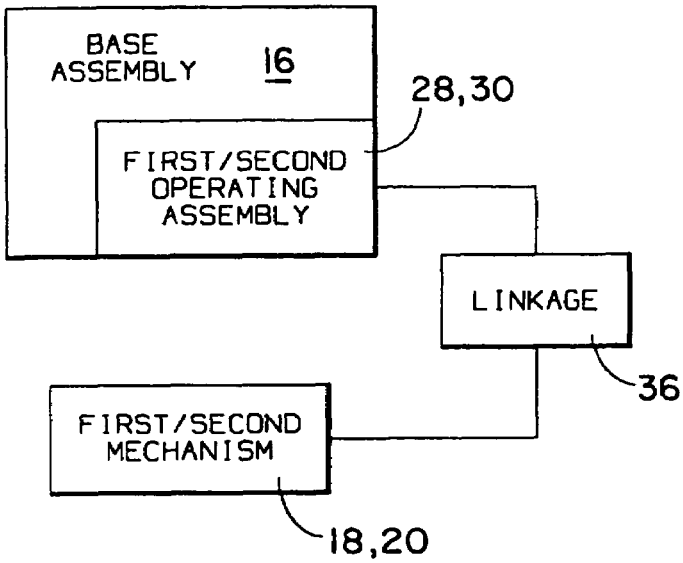
FIG. 8 is a schematic representation of another combination, as in FIG. 7, wherein a linkage acts between the selected first/second operating assembly and first/second mechanism.

As shown in FIG. 7, the first/second operating assemblies 28, 30, that are operably attached to the base assembly 16, may be directly operably interconnected with the first and second mechanisms 18, 20. Alternatively, as shown in FIG. 8, the first and second operating assemblies 28, 30, that are operably attached to the base assembly 16, may be operably interconnected to the first and second mechanisms 18, 20 indirectly, as through a linkage 36.

Figure 9:
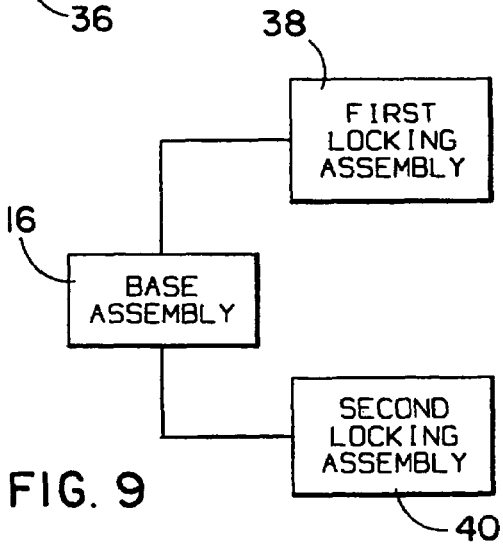
FIG. 9 is a schematic representation of the base assembly to which first and second different lock assemblies can be selectively operably attached.
Figure 10:
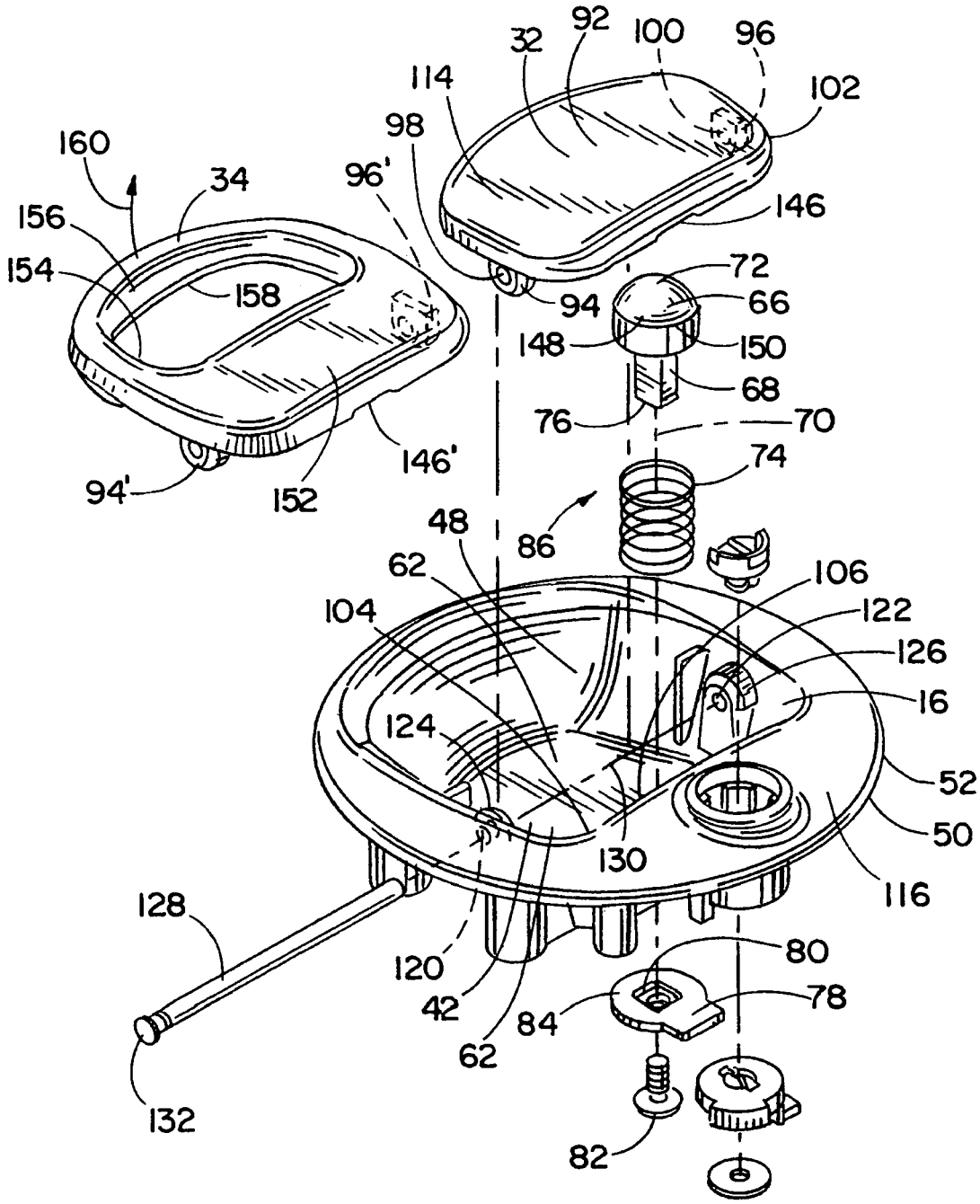
FIG. 10 is an exploded, perspective view of one form of base assembly with selectively interchangeable operating handles as shown in FIG. 6.

As shown in FIG. 9, first and second locking assemblies 38, 40, each of a different construction, can be selectively installed on the base assembly 16, one in place of the other, to selectively prevent operation of the first and second operating mechanisms 18, 20. The locking assemblies 38, 40 may be keyed locking cylinders, or other locking structure known to those skilled in the art.

The components described in FIGS. 1-9 are shown generically to encompass virtually a limitless number of different configurations of components that could be utilized and that would be obvious to one skilled in the art, with the inventive concepts described herein in hand. The invention is intended to encompass all such variations.

Further, the invention contemplates that interchangeability of components can be afforded for a single feature or multiple features. For example, the kit 10 in FIG. 1 includes interchangeable first and second mechanisms 18, 20. In FIG. 6, interchangeable operating assemblies 28, 30 are shown. In FIG. 9, interchangeable first and second locking assemblies 38, 40 are shown. One, two or all three of these operating features can be made interchangeable to afford the desired manufacturing flexibility. Other features that lend themselves to interchangeability are also contemplated by the invention. Specific structures utilizing the inventive concepts described in FIGS. 1-9 will now be described below, with it to be understood that these specific forms are exemplary in nature only, as variations therefrom are contemplated.

In FIGS. 10-30, one form of the kit 10 is shown with one form of the base assembly 16 and first and second mechanisms 18, 20. Each of the mechanisms 18, 20 is in the form of a self-contained module that can be operably interconnected to the base assembly 16.

The base assembly 16, as seen most clearly in FIGS. 10-17, consists of a cup-shaped housing 42 having a front 44 and back 46. The housing 42 has a main body 48 with a peripheral, outturned flange 50 at the front thereof. The body 48 has an effective diameter D that is less than the diameter D1 of the outer edge 52 of the flange 50. The flange 50 thus defines an annular surface 54 that faces rearwardly for abutment to a front surface 56 on the closure element 12 around an opening 58 therein, having a diameter greater than D and less than D1, to accept the body 48. The body 48 has a flat, rearwardly facing, mounting surface 60 against which the first and second mechanisms 18, 20 can be selectively placed, as hereinafter described.

The base assembly 16 may be made from any appropriate material as selected by one skilled in the art. For purposes of cost control, it may be made from a non-metal material such as a plastic or composite. Plastic lends itself to relatively inexpensive molding into the shape shown.

The body 48 has a rearwardly recessed wall 62 through which a non-round/squared opening 64 is formed. The particular shape of the opening 64 is not critical to the present invention and while it could be round, it is preferably a shape that facilitates keying of an actuating component/plunger 66, directed thereinto.

In this particular embodiment, the actuating component/plunger 66 has an elongate stem 68 with a cross-sectional configuration, taken transversely to its length, that will pass guidingly through the opening 64 while keying the stem 68 against rotation within the opening 64 about the lengthwise axis 70 of the stem 68. An enlarged head 72 is provided on the front end of the stem 68.

The actuating component/plunger 66 is assembled by directing the stem 68 through a coil spring 74 and thereafter into and through the opening 64 sufficiently that the back end 76 of the stem 68 is exposed rearwardly of the mounting surface 60. An enlarged plate 78 with a forwardly opening recess 80 to accept the stem end 76, is secured by a fastener 82 that is threaded into the stem 68. The spring 74 acts between the wall 62 and head 72 to urge the actuating component/plunger 66 translatingly in a forward direction to a normally retracted position, wherein a flat surface 84 on the plate 78 abuts to the back of the body 48 to thereby prevent separation of the actuating component/plunger 66 from the body 48.

Figure 11:
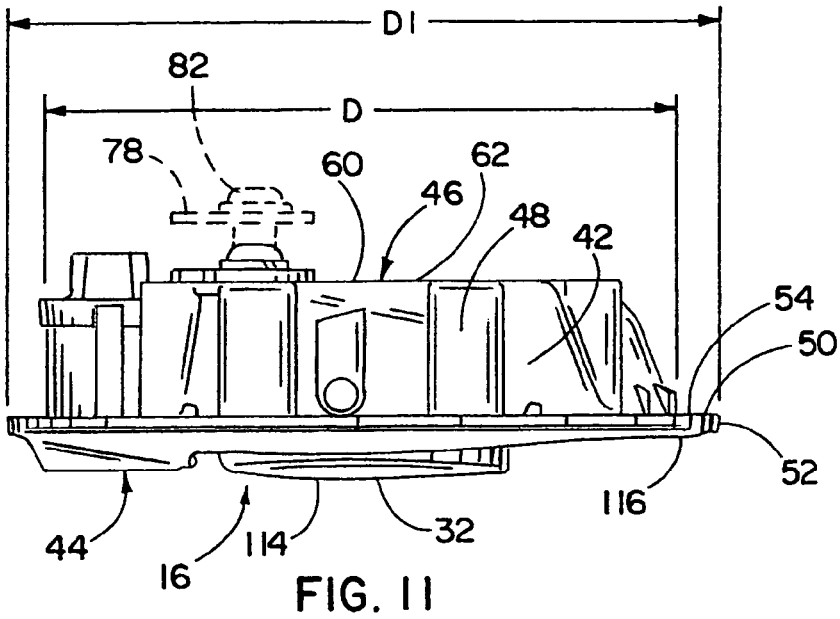
FIG. 11 is a side elevation view of the base assembly in FIG. 10 with one of the operating handles installed thereon and in a normal position.
Figure 12:
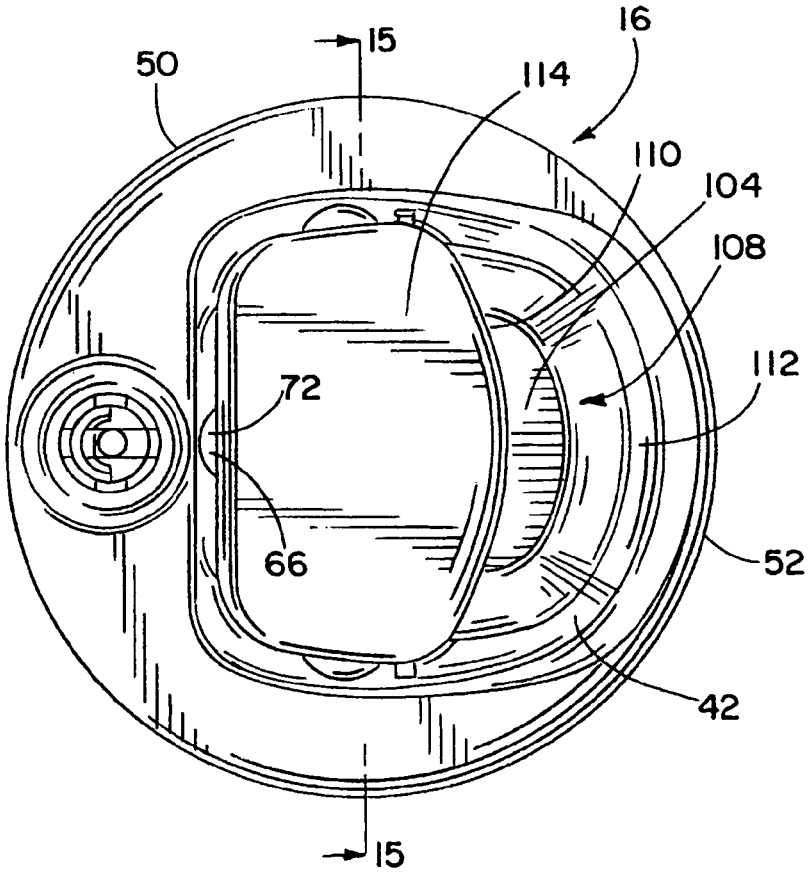
FIG. 12 is a front elevation view of the components in FIG. 11.
Figure 13:
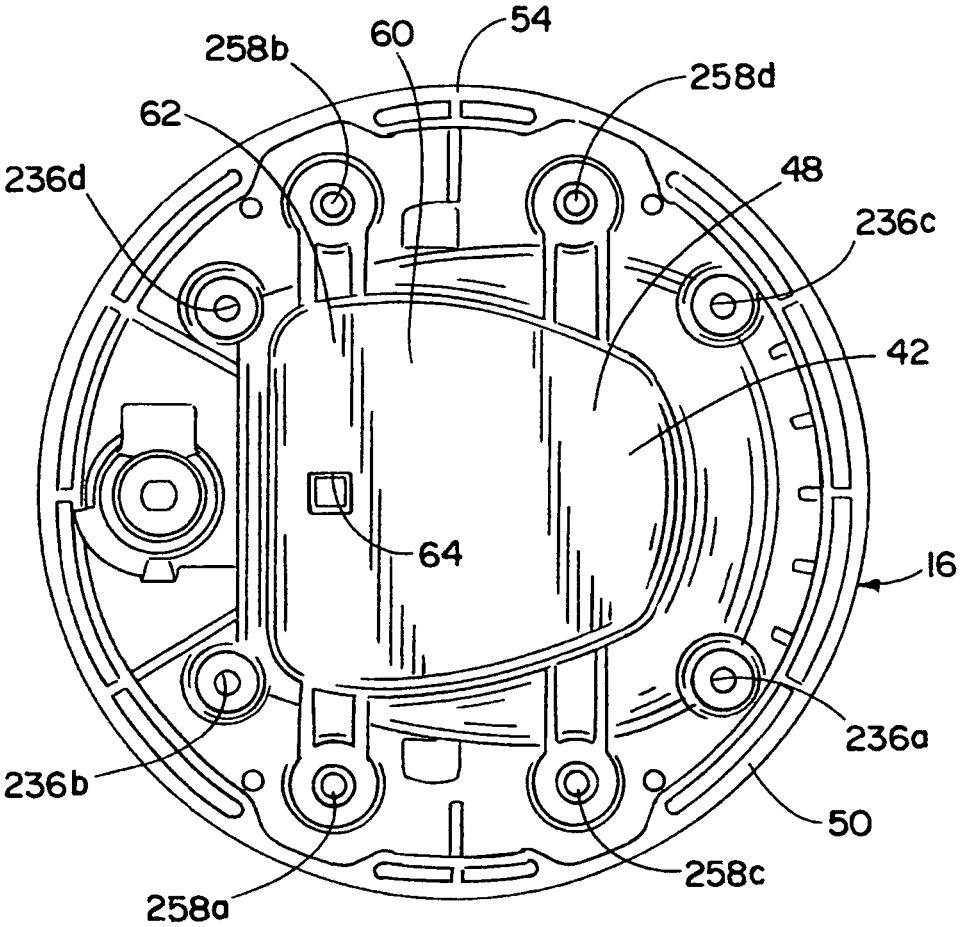
FIG. 13 is an enlarged, rear elevation view of the components in FIGS. 11 and 12.
Figure 14:
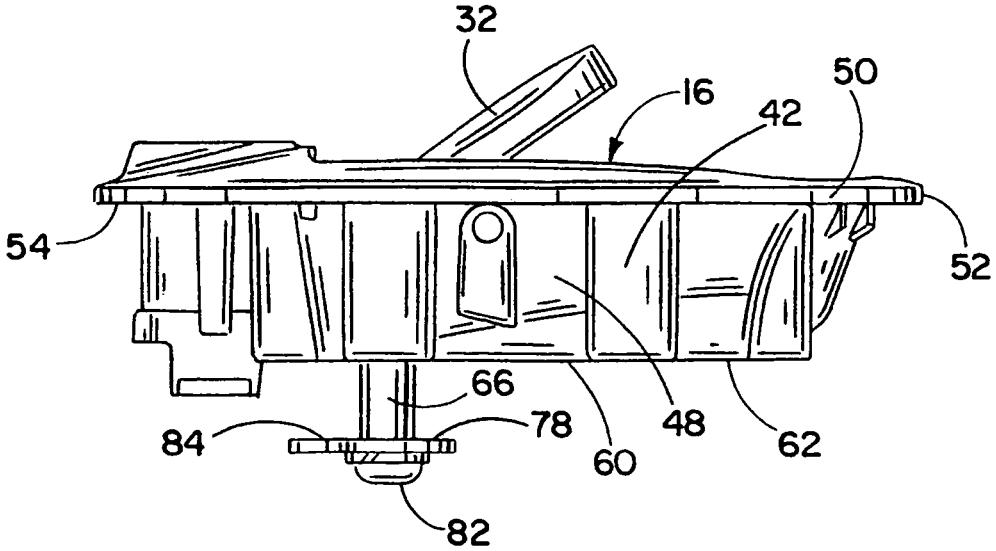
FIG. 14 is an enlarged, elevation view of the components in FIGS. 11-13 from the side opposite that in FIG. 11 and with the operating handle in an actuated position.
Figure 18:
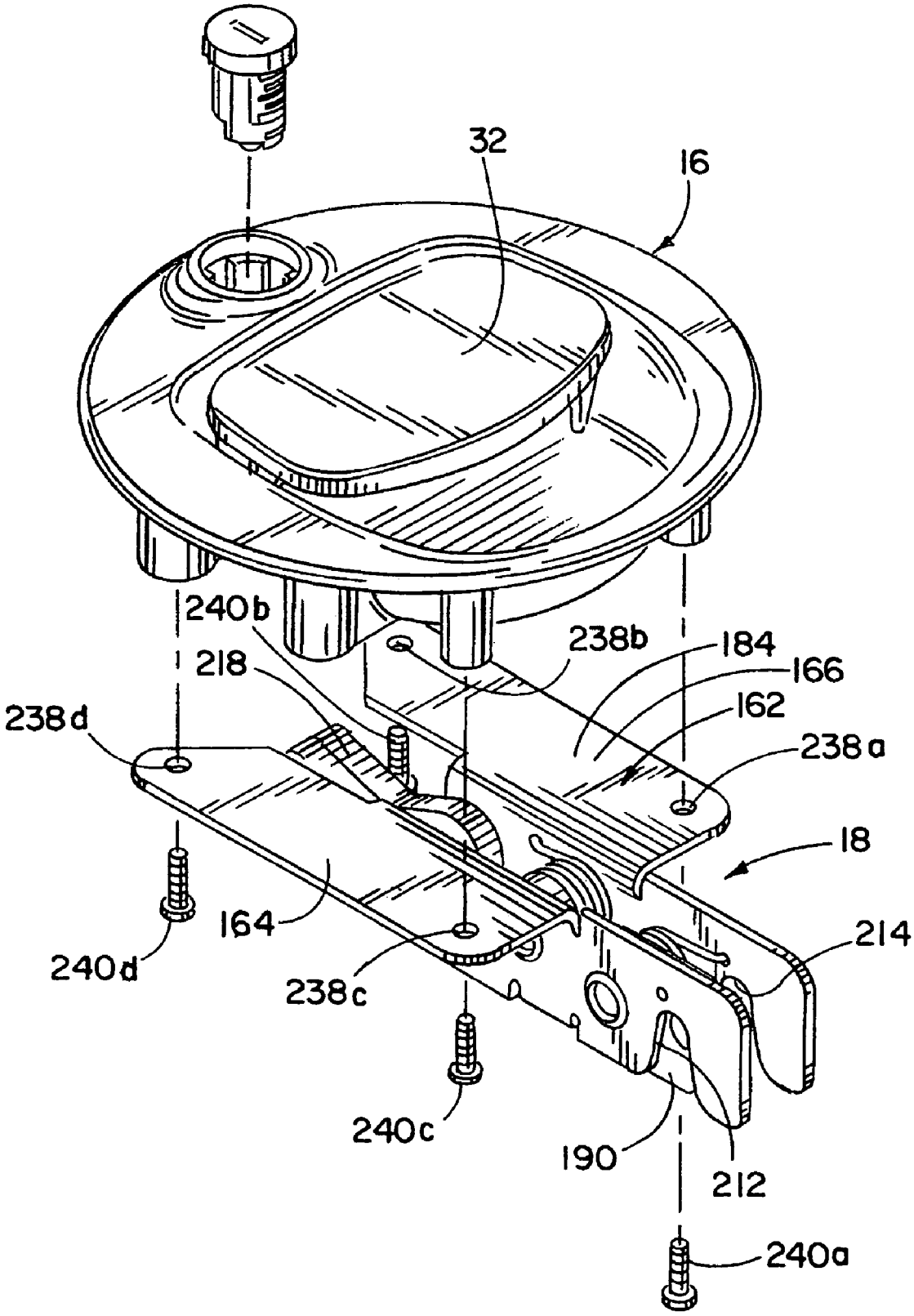
FIG. 18 is an exploded, perspective view, as in FIG. 10, with one of the operating handles operatively connected and with a first type of mechanism operatively interconnected to the base assembly.
Figure 19:
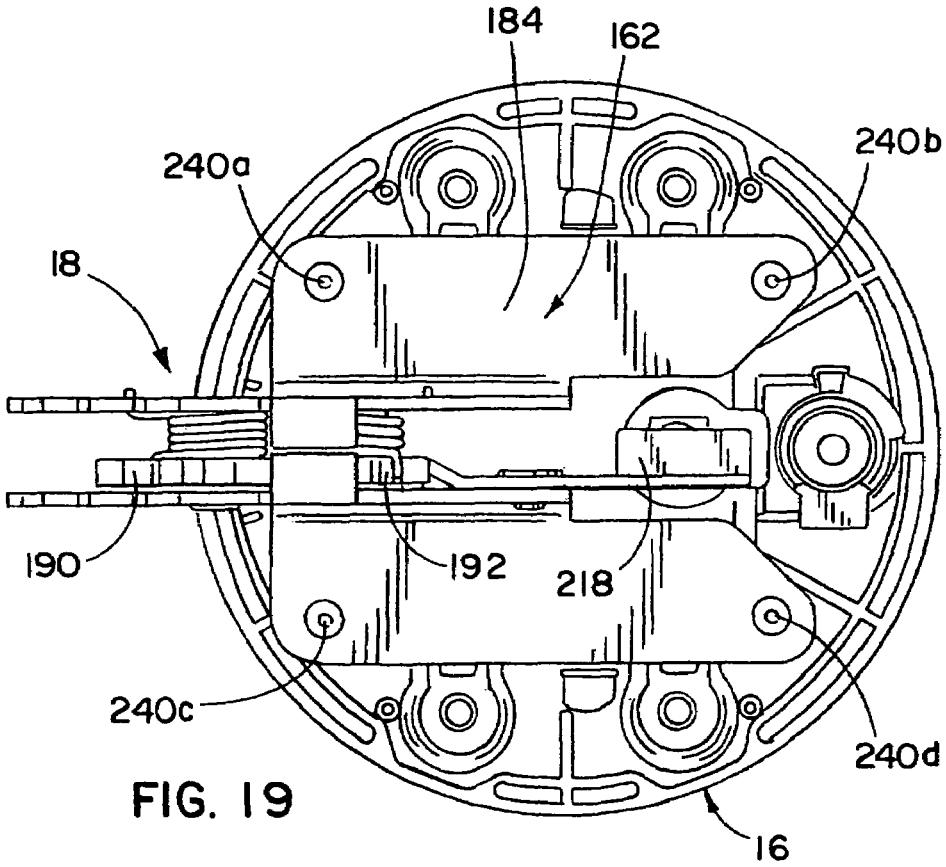
FIG. 19 is a rear elevation view of the components in FIG. 18.

With this arrangement, the actuating component/plunger 66, to include the plate 78 and fastener 82, can be translated back and forth in a fore-and-aft linear path between the retracted position, shown in solid lines in FIG. 11 and an extended position, shown in dotted lines in FIG. 11 and in solid lines in FIG. 14. The actuating component/plunger 66, spring 74, plate 78, and fastener 82 together define an actuating assembly 86 that can be used potentially with all variations of the invention, as herein described. However, again this is not a requirement. Actuating is effected by changing the actuating component/plunger 66 from the retracted position into the extended position therefor.

Repositioning of the actuating assembly 86 is effected through the operative one of the first and second operating assemblies 28, 30, consisting respectively in this embodiment of first and second handles 32, 34. The exemplary handle 32 consists of a generally flat, graspable paddle 92 from which spaced tabs 94, 96 project in a rearward direction. The tabs 94, 96 have coaxial through bores 98, 100, respectively.

The first handle 32 has a peripheral edge 102 that conforms nominally to a cup-shaped surface 104 on the body 48 that opens in a forward direction. The first handle 32 fits adjacent to one side 106 of the surface 104 SO that a gap 108 is maintained between an edge portion 110 of the first handle 32 and a sloped side 112 of the surface 104 opposite to the side 106.

With the first paddle 88 operatively installed, a front surface 114 thereon nominally conforms to the shape of the front surface 116 of the body 48 in flush or near flush relationship, as seen clearly in FIG. 11. In this operative position, the common axis 118 for the bores 98,100 is centrally aligned with bores 120, 122, respectively defined through bosses 124, 126 on the body 48.

A pin/axle 128 is directed through the aligned bores 98, 100, 120, 122 to thereby support the first handle 32 for guided pivoting movement about an axis 130 between the normal position, as shown in FIG. 11, and a release position, as shown in FIG. 14.

The pin/axle 128 has an enlarged head 132 at one end of a shank 134. The shank 134 has straight knurling 136 extending in a lengthwise direction about the periphery thereof adjacent to the location of the head 132. With the pin/axle 128 fully inserted, the knurling 136 digs into the surface 138 around the bore 120 to positively maintain the inserted position of the pin/axle 128. In this fully inserted position, the head 132 abuts with a surface 140 on the body 48 to assure consistent assembly of the pin/axle 128.

The end 142 of the shank 134 opposite to the head 132 is tapered to facilitate guided movement of the pin/axle 128 into and through the bores 98, 100, 120, 122. With the pin/axle 128 fully inserted, the end 142 of the shank 134 projects through and beyond a surface 144 on the body 148 facing oppositely to the surface 140.

As the first handle 32 is pivoted from its normal position into its release position, a camming action is produced on the actuating component/plunger 66 that causes the actuating component/plunger 66 to change from the retracted position into the extended position. More particularly, as shown additionally in FIGS. 27 and 28 with a modified form of actuating component/plunger 66', the first handle 32 has a cam edge 146 that bears on a rounded/crowned surface 148, 148' on the top of the head 72, 72' of the actuating component/plunger 66, 66'. With the actuating component/plunger 66, 66' in the retracted position, pivoting of the first handle 32 from the normal position towards the release position causes the cam edge 146 to bear upon the surface 148, 148' at a location between the center and a peripheral edge 150, 150' thereon. Continued pivoting of the first handle 32 towards the release position causes the edge 146 to progressively shift towards the peripheral edge 150, 150', in the process producing a rearward camming force component that urges the actuating component/plunger 66, 66' from the retracted position of FIGS. 11 and 27 into the extended position of FIGS. 14 and 28.

Figure 27:
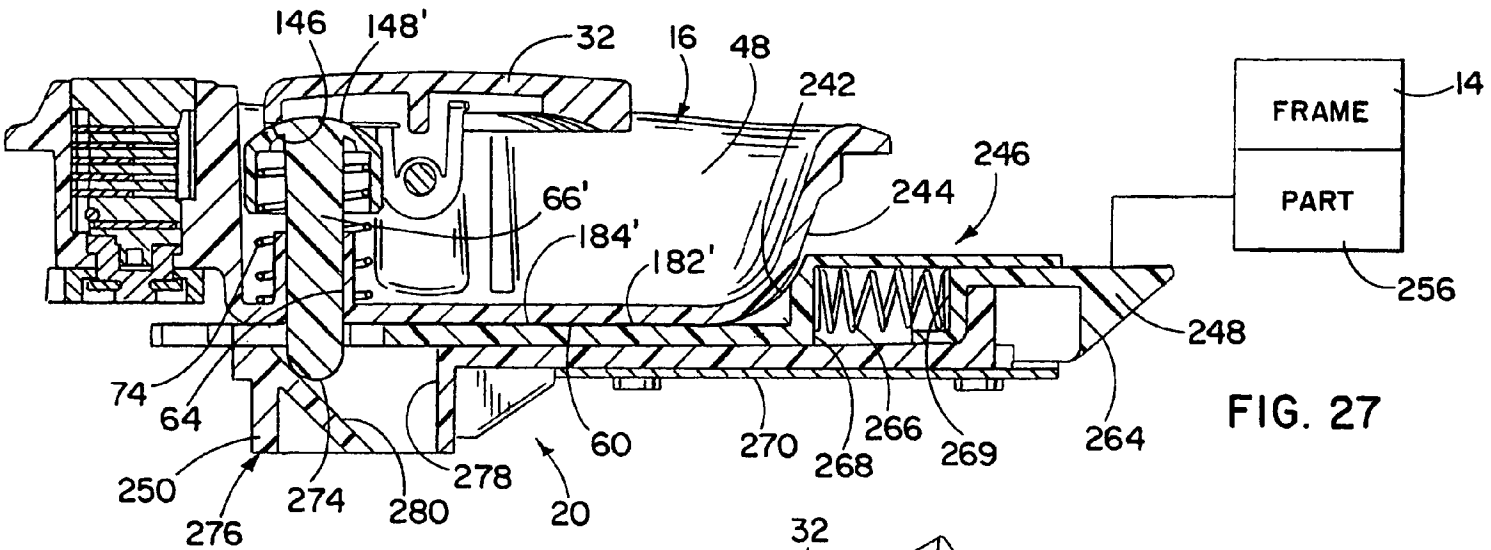
FIG. 27 is a cross-sectional view of the components in FIGS. 24 with the operating handle in a normal position.

The spring 74 normally urges the actuating component/plunger 66 towards the retracted position, whereby the actuating component/plunger 66,66' moves the first handle through a camming action that is reversed to that described for actuation. Thus, the first handle 32 is normally biased into its normal position, as shown in FIGS. 11 and 27.

The user repositions the first handle 32 by directing one or more fingers through the gap 108 to underneath the first handle 32 at the edge part 110, thereby allowing the handle 32 to be grasped between the thumb and fingers. The user can then exert a pivoting force on the first handle 32 to change the same from the normal position to the release position, thereby changing the actuating component/plunger 66, 66' from the retracted position into the extended position.

The second handle 34 is, as previously mentioned, useable interchangeably with the first handle 32 SO that the manufacturer/end user can select a desired handle configuration useable with the base assembly 16. The second handle 34 has a body 152 with corresponding, rearwardly projecting tabs 94', 96' through which the pin/axle 128 can be extended to operatively interconnect the handle 34 with the base assembly 16 in the same manner that the handle 32 is interconnected to the base assembly 16.

The handle 34 is what is conventionally referred to as a bail-type handle. The perimeter of the body 152 is configured to nominally match the front profile of the cup-shaped surface 104. A D-shaped opening 154 is formed through the body 152 to form a curved "bail" portion 156.

The handle 34 is likewise biased by the spring 74 towards a normal position, corresponding to that for the handle 32. To effect operation thereof, the user directs one or more fingers through the opening 154 to facilitate engagement of the user's fingers at an edge 158 under the bail portion 156, potentially with a grasping action. The edge 158 can be drawn in the direction of the arrow 160 (FIG. 10) to urge the cam edge 146' against the component/plunger 66, thereby to change the position of the handle 34 from its normal position into its release position.

The handles 32, 34, associated with the operating assemblies 28, 30, represent just two exemplary configurations for the handles 32, 34 thereon. Other configurations of the handles, be they graspable or otherwise operable, are contemplated. Further, as noted above, different types of operating assemblies might be utilized in place of, or in conjunction, with those utilizing the handles 32, 34.

Details of the first mechanisms 18 are shown in FIGS. 18-23. The first mechanism 18, as discussed above, is in the form of a module, built around a housing 162 consisting of joined first and second parts 164, 166. The housing parts 164, 166 are joined to each other in fixed relationship by a pair of axles 168, 170 that additionally provide support for the operating components of the mechanism 18. The axles 168, 170 join between flat walls 172, 174 that are maintained in a predetermined spaced relationship by the axles 168, 170, So as to define therebetween a compartment 176 for the operating components. The walls 172, 174 respectively have transverse portions 178, 180 which cooperatively define a mounting plate 182 with a flat mounting surface 184.

The components on the first mechanism 18 form a latch assembly for a part/strike element 188 on the frame 14. The latch components, that are generally conventional in construction and operation, include a rotor 190 and a catch 192. The rotor 190 has a U-shaped surface 194 defining a receptacle for the strike element 188. The rotor 190 is pivotable about an axis 196 defined by the axle 170 between the latched position, shown in solid lines in FIG. 23, and a release position, shown in dotted lines in that same Figure. Through a torsion, coil spring 198, the rotor 190 is normally biased towards the release position.

Figure 23:
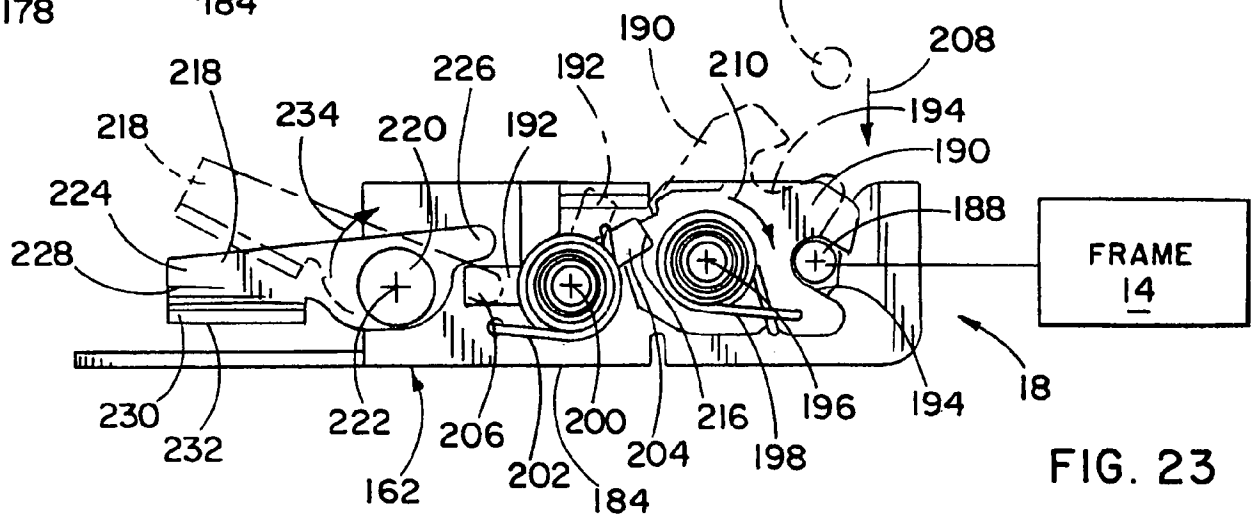
FIG. 23 is a side elevation view of the latch assembly in FIGS. 18-22.
Figure 24:
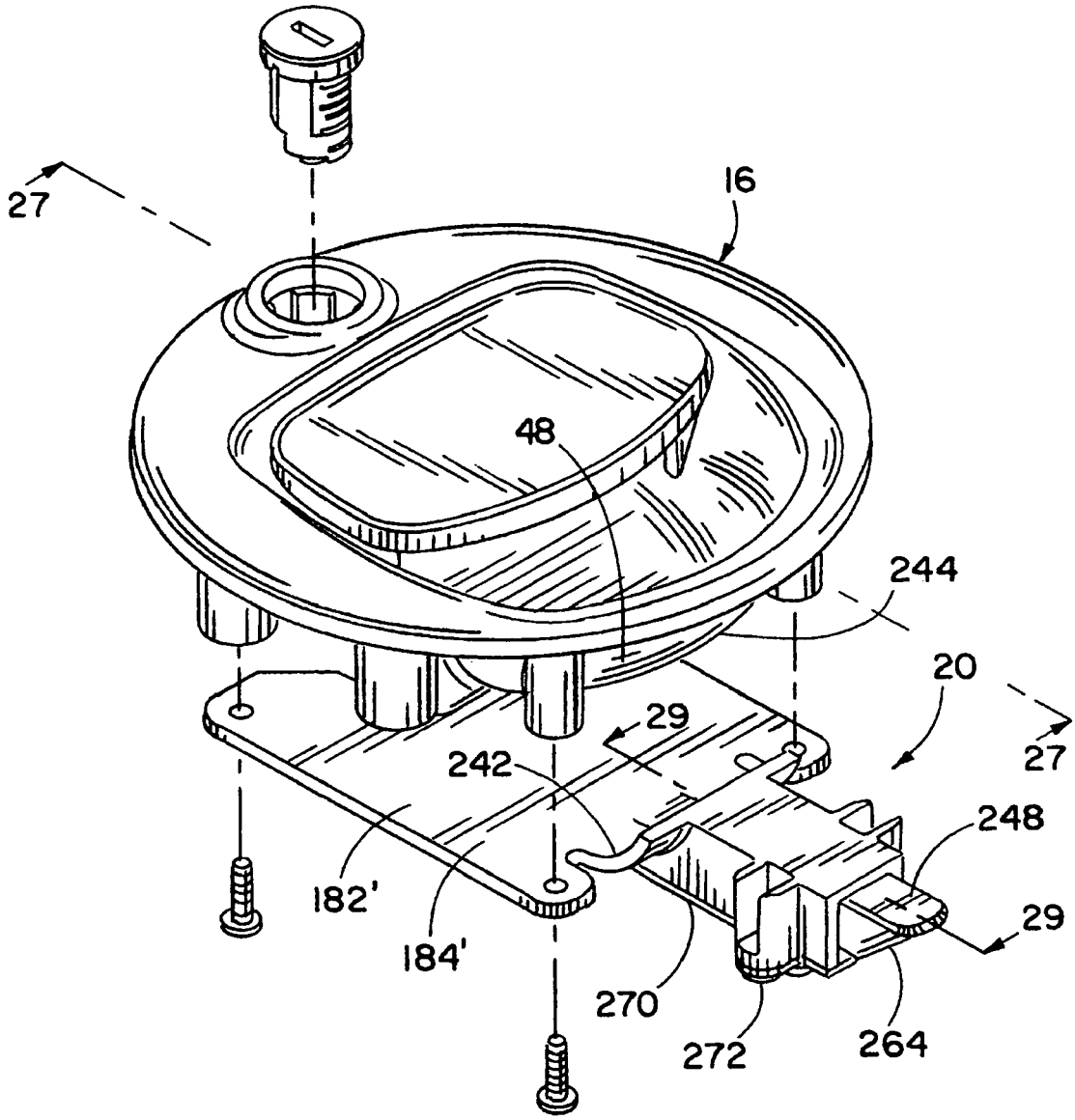
FIG. 24 is a view as in FIG. 18 wherein a second mechanism is used in place of the first mechanism on the base assembly.
Figure 25:
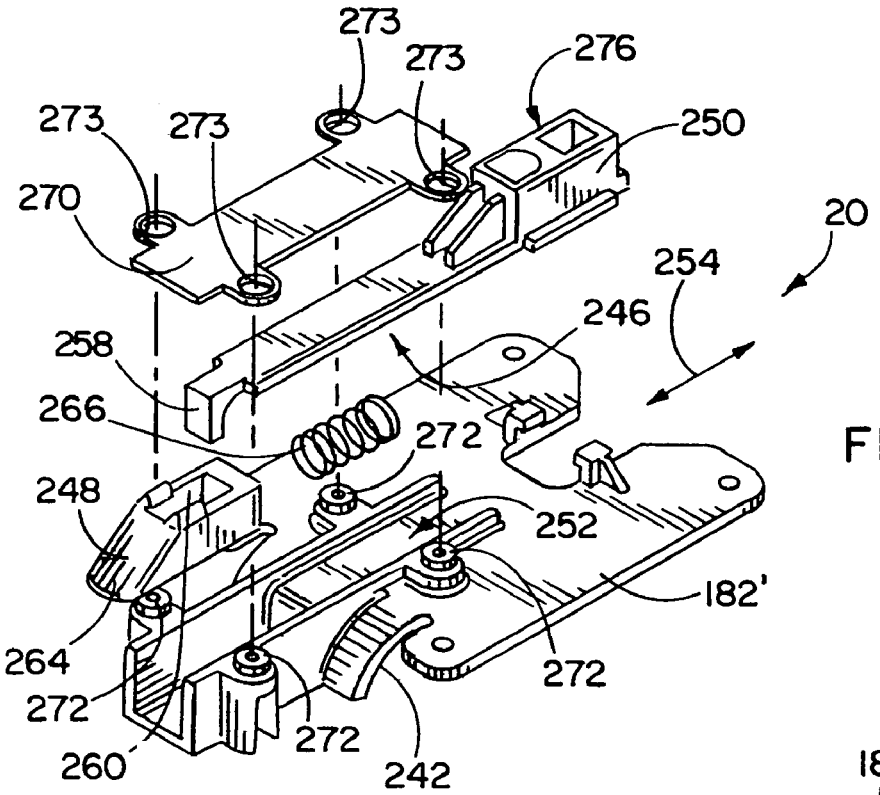
FIG. 25 is an exploded, perspective view of the second mechanism in FIG. 24.
Figure 26:
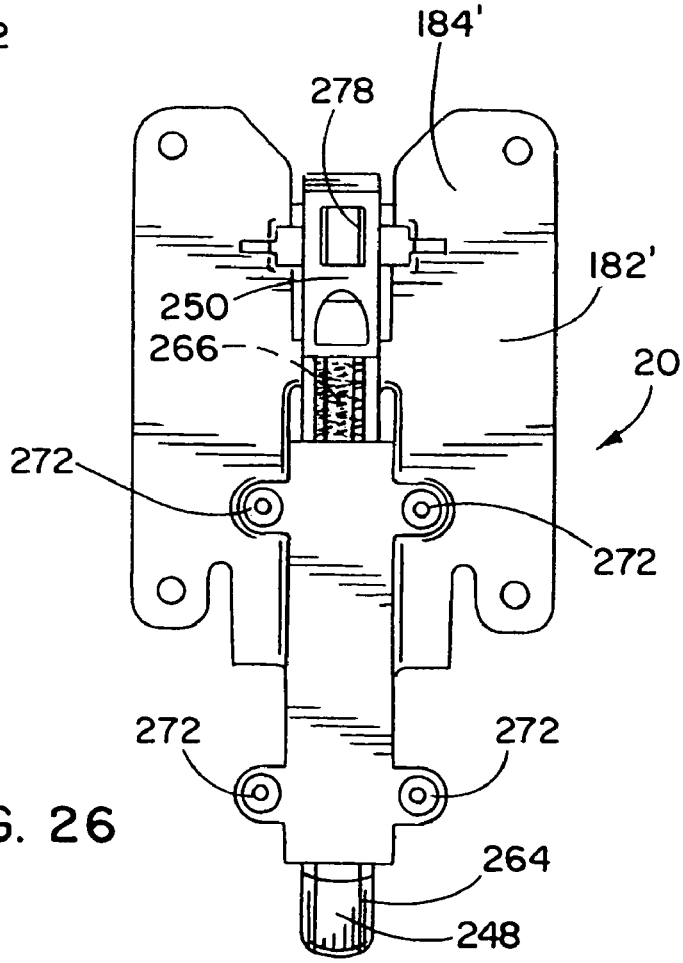
FIG. 26 is a rear elevation view of the mechanism in FIGS. 24 and 25.

The catch 192 is movable around a central axis 200 of the axle 168 between an engaged position, shown in solid lines in FIG. 23, and a disengaged position, shown in dotted lines in that same Figure. Through a torsion, coil spring 202, the catch 192 is normally urged toward the engaged position. The catch 192 has projecting operating and actuating arms 204, 206, respectively.

With the mechanism 18 operatively attached to the closure element 12, movement of the closure element 12, as from an open position towards a closed position, causes the strike element 188 to move, as shown in FIG. 23, in the direction of the arrow 208 towards the surface 194 on the rotor 190 in the release position therefor. Continued movement of the closure element 12 causes the strike element 188 to urge the rotor 190 in the direction of the arrow 210 around the axis 196 eventually into the latched position therefor, wherein the strike element 188 is surrounded by the U-shaped surface 194 and edges 212, 214 around cut-outs on the housing parts 164, 166, respectively. This position is releasably maintained by the catch operating arm 204, that bears against a rotor edge 216. With the strike element 188 so held, the closure element 12 is maintained in its first predetermined position.

A release lever 218 is mounted to the housing part 164 through a rivet 220 for pivoting movement about an axis 222 that is substantially parallel to the axes 196, 200. The release lever 218 has a flat body 224 with an actuating projection 226 and operating arm 228 at diametrically opposite locations with respect to the axis 222. The operating arm 228 has a transverse flange 230 defining a flat actuating surface 232. Pivoting of the release lever 218 around the axis 222 in the direction of the arrow 234 in FIG. 23 causes the actuating projection 226 to bear upon the actuating arm 206 on the catch 192, thereby to pivot the catch 192 from the engaged position into the disengaged position, whereupon the rotor 190, under the force of the coil spring 198, is pivoted from the latched position into the release position. This permits the closure element 12 to change from the first predetermined position into a second position. As noted above, the first and second positions may be open and closed positions, or other relative positions for the closure element 12.

As noted above, the first mechanism 18 is preferably operably interconnectable with the base assembly 16 as a self-contained module. To facilitate this connection, as shown additionally in FIG. 13, the body 48 has pre-formed bores 236*a*, 236*b*, 236*c*, 236*d*, alignable one each with preformed bores 238*a*, 238*b*, 238*c*, 238*d* through the mounting plate 182 on the first mechanism 18. With the flat mounting surface 184 on the mounting plate 182 facially against the flat mounting surface 60 on the body 48 of the base assembly 16, four fasteners 240*a*, 240*b*, 240*c*, 240*d* can be directed respectively through the aligned bores 236*a*, 238*a*; 236*b*, 238*b*; 236*c*, 238*c*; and 236*d*, 238*d* to maintain the first mechanism 18 operatively upon the base assembly 16. The fasteners 240*a*, 240*b*, 240*c*, 240*d* may be threaded, in rivet form, molded in place, or otherwise configured as appropriate for the particular materials and design.

Figure 20:
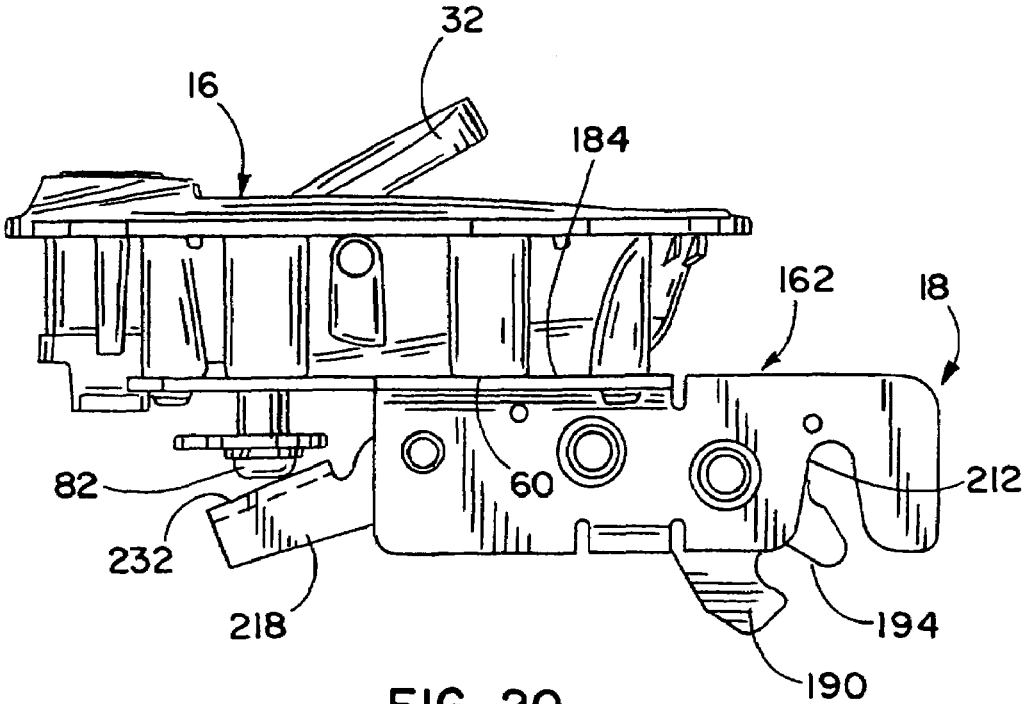
FIG. 20 is a side elevation view of the components in FIGS. 18 and 19 with the latch assembly thereon in a release state.
Figure 21:
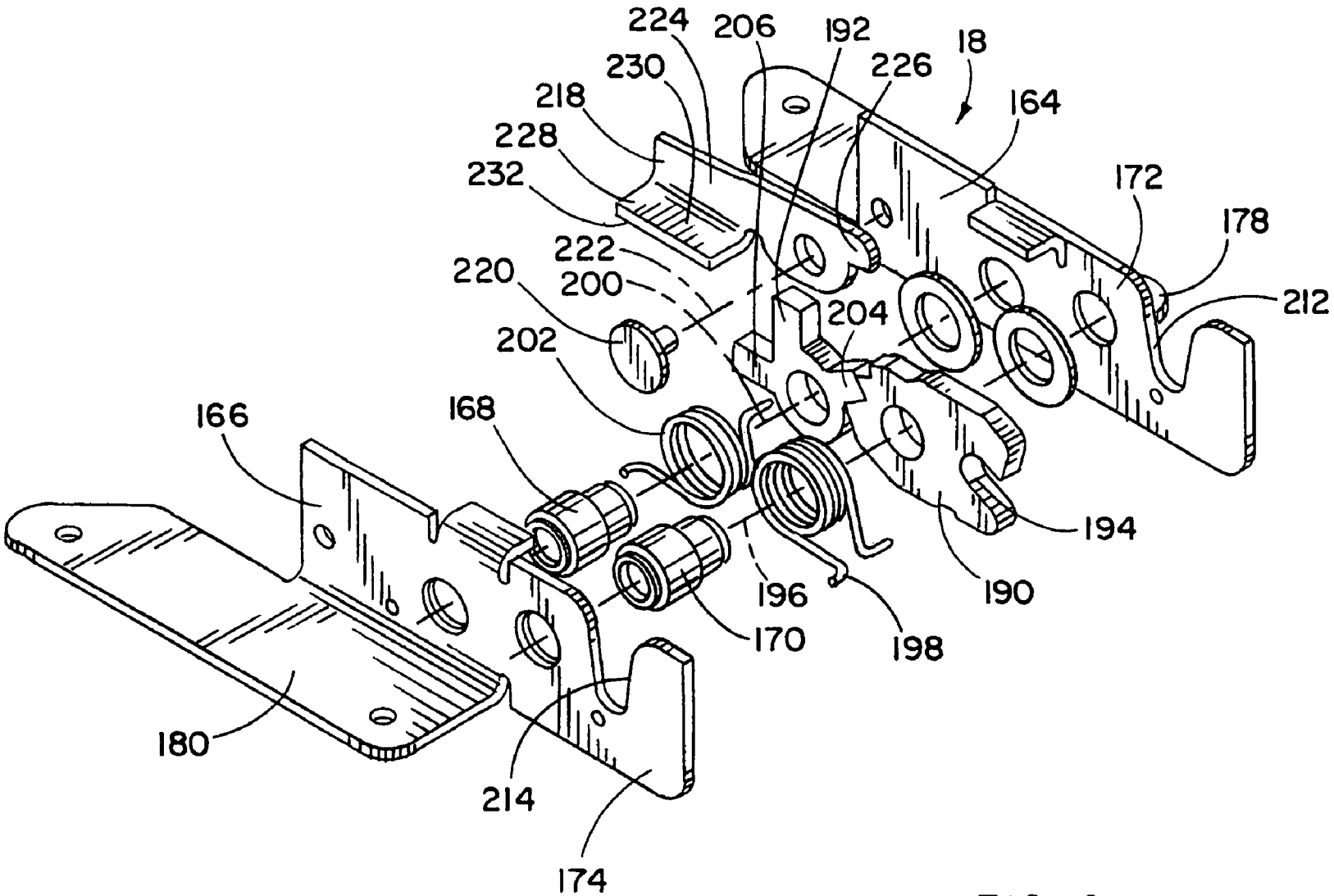
FIG. 21 is an exploded, perspective view of the latch assembly on the mechanism shown in FIGS. 18-20.
Figure 22:
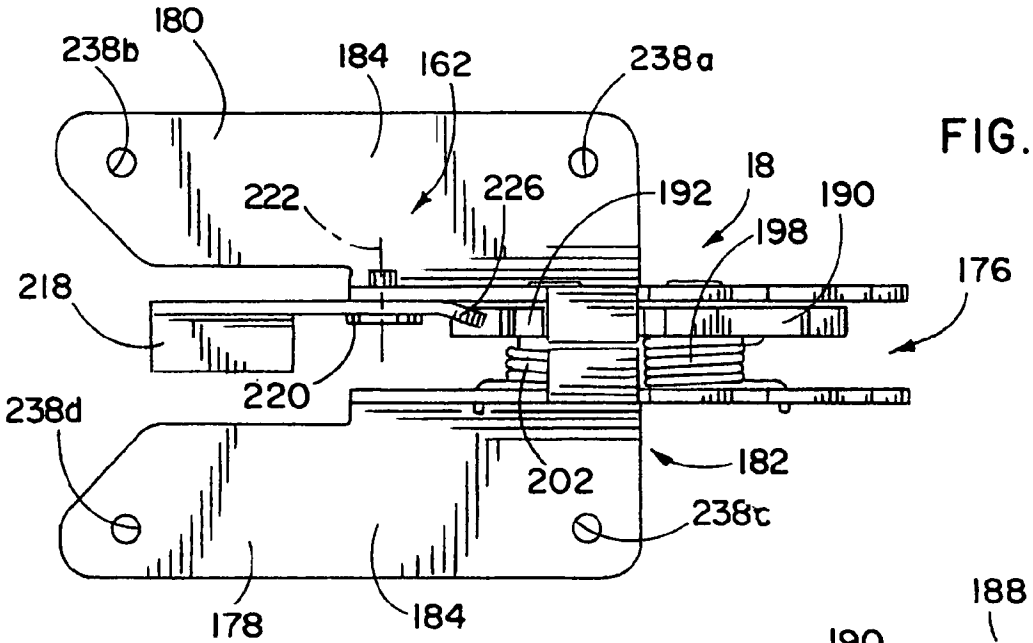
FIG. 22 is a front elevation view of the mechanism shown in FIGS. 18-21.

With the rotor 190, catch 192, and release lever 218 in their solid line positions of FIG. 23, the first mechanism 18 is in a first state in which the closure element 12 is maintained in the predetermined first position. In this state, the actuating arm 206 on the catch 192 bears on the actuating projection 226 to situate the release lever 218 in a first position, as shown in solid lines. In this first position, the flat actuating surface 232 resides in the path of the actuating component/plunger 66 on the base assembly 16. As the actuating component/plunger 66 is changed from the retracted position therefor into the extended position, as shown in FIG. 20, the fastener 82 at the end of the actuating component/plunger 66 cammingly engages the surface 232 and progressively pivots the release lever 218 from the first, solid line position of FIG. 23, to a second position, as shown in dotted lines in FIG. 23 and solid lines in FIG. 20. As the release lever 218 moves from its first position into its second position, the actuating projection 226 thereon is caused to change the catch 192 from the engaged position to the disengaged position therefor, in turn causing the rotor 190 to change from the latched position into the release position therefor.

As noted above, the second mechanism 20 is likewise preferably installed as a self-contained module in place of the first mechanism 18. Details of the second mechanism are shown in FIGS. 24-30. The mechanism 20 consists of a mounting plate 182' defining a flat mounting surface 184' that bears facially against the mounting surface 60 on the base assembly 16 with the mechanism 20 operatively attached. The flat mounting surface 184' continues to a curved surface portion 242 which conforms nominally to the outside 244 of the body 48 of the base assembly 16.

The mechanism 20 consists of a plunger assembly at 246 consisting of first and second plunger parts 248, 250. The plunger assembly 246 is guided in a track 252 on the mounting plate 182' for translating movement along a line, indicated by the double headed arrow 254, between a latched position, as shown in FIG. 27, wherein the first plunger part 248 projects to cooperate with a part 256 on the frame 14 and the mechanism 20 is in a first state to maintain the associated closure element 12 in the predetermined first position, and an unlatched/release position, as shown in FIG. 28, wherein the plunger part 248 is retracted and the mechanism 20 is in a second/release state, wherein the closure element 12 is allowed to move from the predetermined first position into a second position.

The second plunger part 250 has a transverse leg 258 that is received in an elongate receptacle 260 on the first plunger part 248. With this arrangement, the first plunger part 248 can be translated guidingly relative to the second plunger part 250 along the line indicated by the arrow 254 to allow the first plunger part 248 to be moved in the direction of the arrow 262 (FIG. 28), independently of the second plunger part 250, within a range dictated by the length of the receptacle 260.

Figure 28:
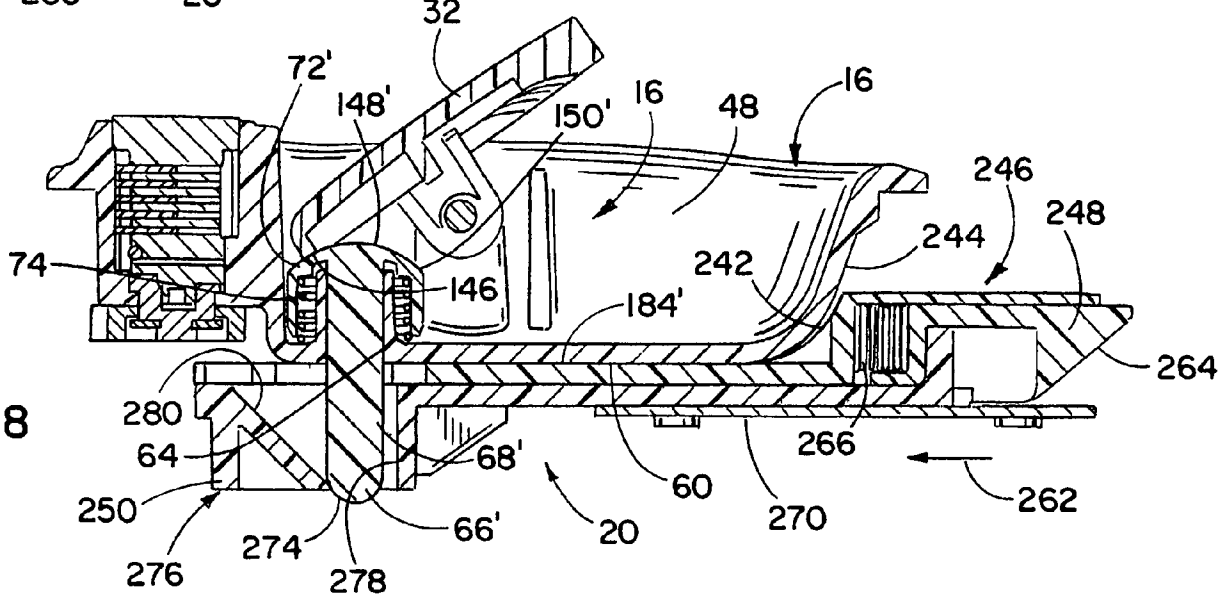
FIG. 28 is a view corresponding to that in FIG. 27 wherein the operating handle is repositioned to an actuated position.
Figure 29:
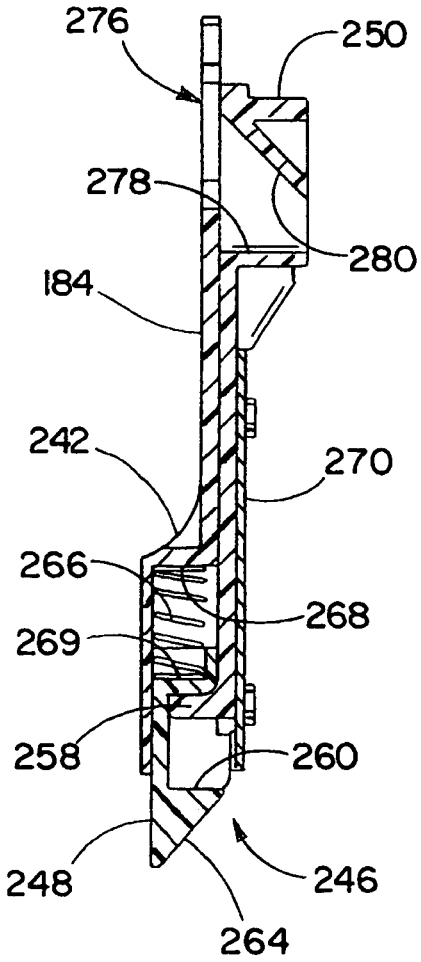
FIG. 29 is a cross-sectional view of a part of the second mechanism taken along lines 29-29 of FIG. 24.
Figure 30:
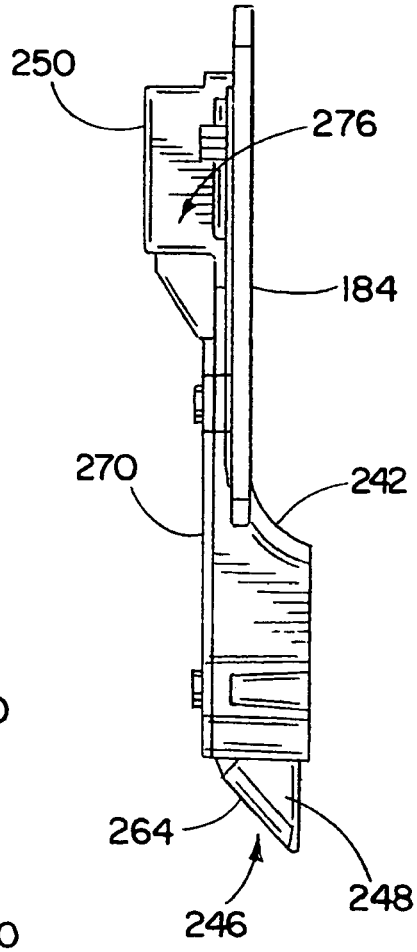
FIG. 30 is a view as in FIG. 29, but not in cross section.
Figure 31:
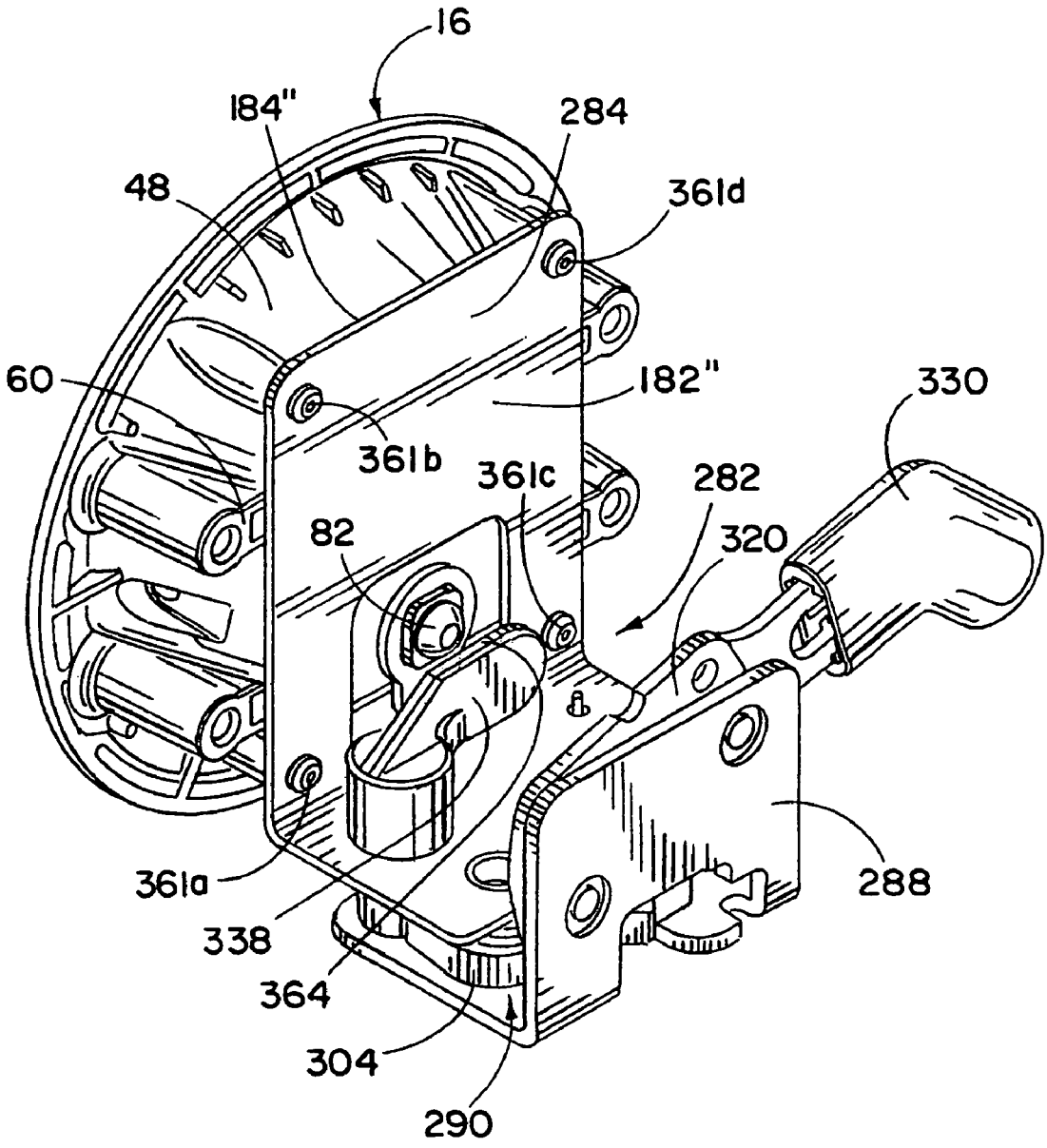
FIG. 31 is a rear perspective view of a third mechanism, according to the present invention, operatively associated with the base assembly.
Figure 32:
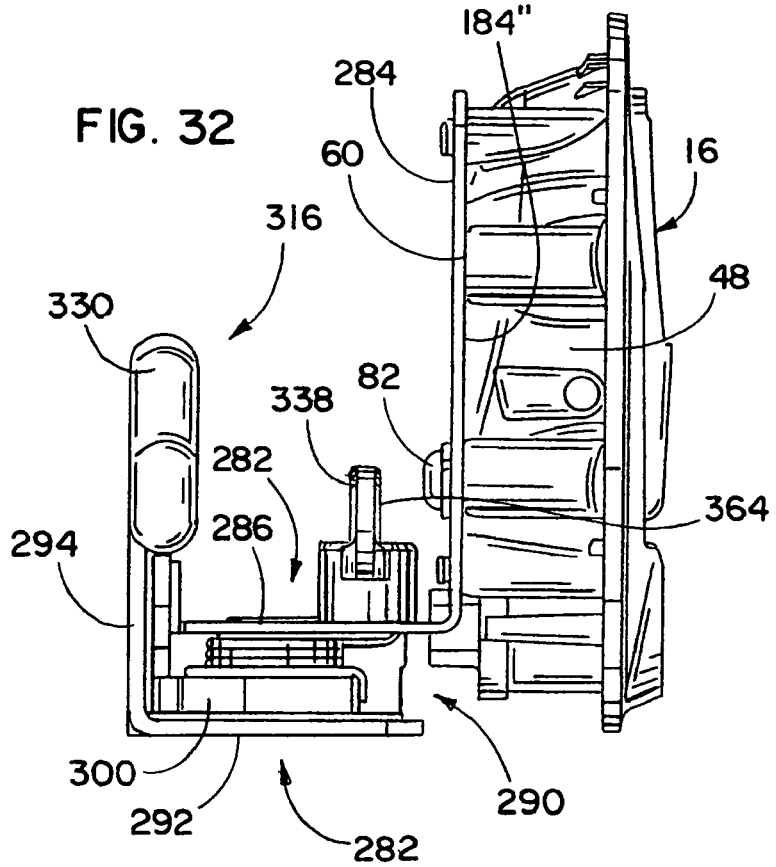
FIG. 32 is a side elevation view of the components in FIG. 31.
Figure 33:
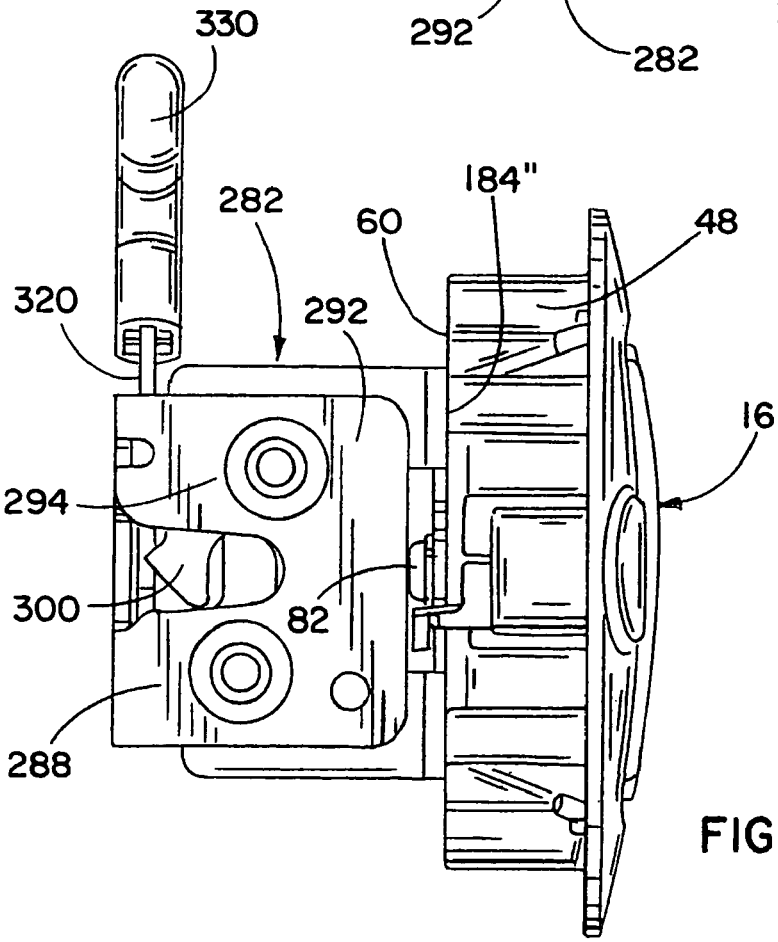
FIG. 33 is a bottom view of the components in FIGS. 31 and 32.
Figure 34:
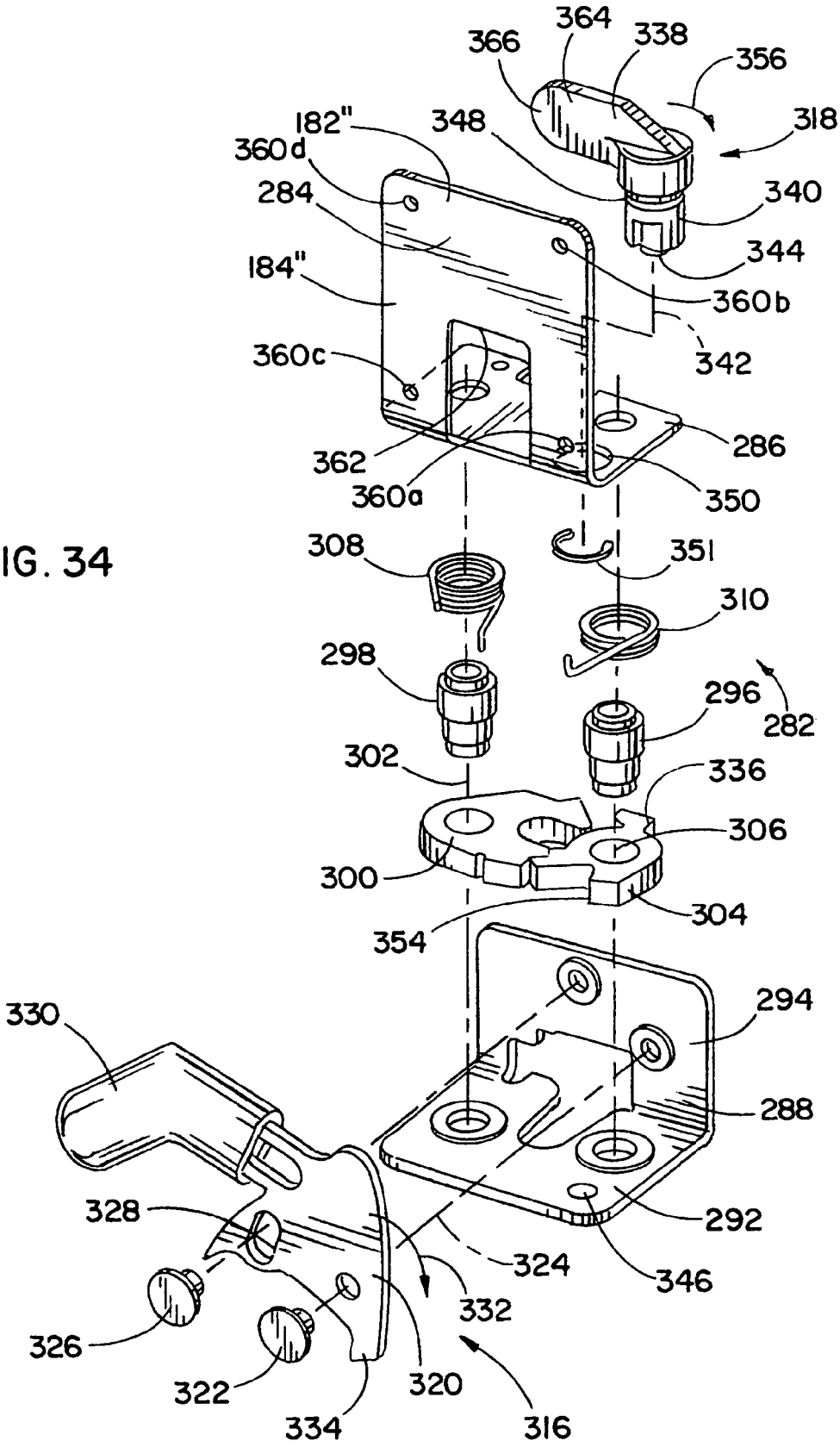
FIG. 34 is an exploded, perspective view of the third mechanism.

With this configuration, as the closure element 12 with the mechanism 20 thereon is moved towards the predetermined first position, the part 256 on the frame 14 contacts an inclined cam surface 264 on the first plunger part 248 and progressively biases the plunger part 248 in the direction of the arrow 262 in FIG. 28 to allow the closure element 12 to realize the first predetermined position, whereupon the first plunger part 248 is moved back into the position shown in FIG. 27 to maintain the predetermined first position for the closure element 12. A coil spring 266 acts between a shoulder 268 on the second plunger part 250 and a wall 269 on the first plunger part 248 to normally bias the first plunger part 248 towards the position shown in FIG. 27. The plunger assembly 246 is maintained captively within the track 252 by a cover plate 270 that is secured to the mounting plate 182' by posts 272 on the mounting plate 281'. The posts 272 are directed through openings 273 in the cover plate 270 and staked.

To use the mechanism 20, the actuating component/plunger 66 may be used or, alternatively, the modified form of actuating component/plunger 66' may be utilized. While the head 72' on the actuating component/plunger 66 corresponds to the head 72 on the actuating component/plunger 66, the stem 68', extending therefrom, is made with a rounded free end 274 remote from the head 72'. The stem 68' may be rounded in cross-sectional configuration to freely guidingly move within the square opening 64 in the base assembly 16, or may be squared, or non-round, as previously described for the stem 68, to be keyed against rotational movement therewithin.

The actuating component/plunger 66' cooperates with structure on an enlarged portion 276 on, and adjacent to an end of, the second plunger part 250, remote from the leg 258. More particularly, the enlarged portion 276 has a through opening 278 bounded by an inclined cam surface 280. The cam surface 280 resides in the path of the actuating component/plunger 66' as it is moved between the retracted position of FIG. 27 into the extended position of FIG. 28. As the handle 32 is pivoted from the normal position of FIG. 27 to the release position of FIG. 28, the edge 146 on the handle 32 cams the actuating component/plunger 66' from the retracted position of FIG. 27, to the extended position of FIG. 28. As this occurs, the rounded free end 274 acts against the cam surface 280 and progressively cams the entire plunger assembly 246 in the direction of the arrow 262 in FIG. 28 to thereby change the mechanism 20 into its second state of FIG. 28, wherein the associated closure element 12 can be moved from the predetermined first position into a second position, which may be closed and opened, respectively, or other positions.

An alternative, third mechanism useable in place of the first and second mechanisms 18, 20, is shown at 282 in FIGS. 31-36. The third mechanism 282 is likewise preferably in the form of a self-contained module having a housing with an L-shaped mounting plate/housing part 182" with a flat mounting surface 184" that is facially abuttable to the mounting surface 60 on the body 48 of the base assembly 16, with the mechanism 282 operatively connected with the base assembly 16.

The mounting plate 182" consists of a mounting wall 284 upon which the mounting surface 184" is defined, and an orthogonal wall 286, that bounds, in conjunction with a separate housing part 288, a compartment 290 for operating components, as hereinafter described. The housing part 288 is L-shaped, with first and second transverse walls 292, 298, respectively.

Axles 296, 298 connect between the walls 286, 292 and maintain the desired dimension for the compartment 290. A rotor 300 is mounted on the axle 298 for guided movement around an axis 302 defined by the axle 298. A catch 304 is mounted to the axle 296 for guided movement relative thereto around an axis 306 that is substantially parallel to the axis 302.

The rotor 300 and catch 304 operate substantially in the same manner as the rotor 190 and catch 192 do in the embodiment described above. More particularly, the rotor 300 is movable between a latched position, as shown in solid lines in FIG. 35, and a release position, as shown in dotted lines in that same Figure. Through a torsion coil spring 308, the rotor 300 is normally biased towards its release position.

Figure 35:
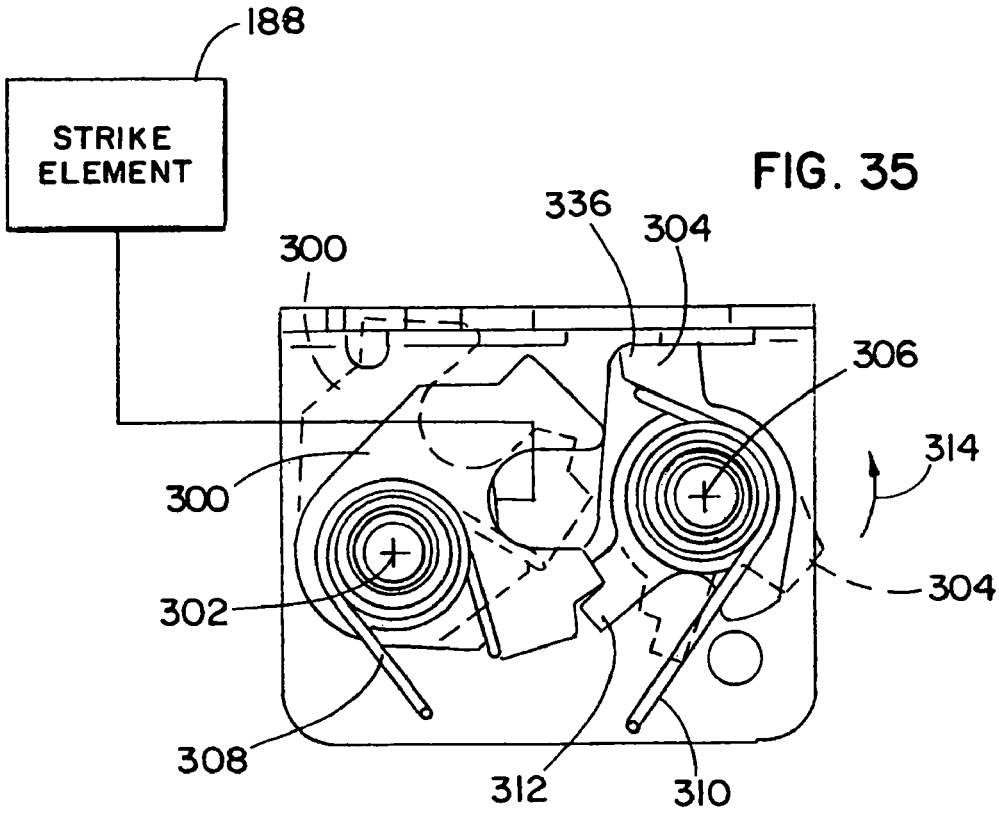
FIG. 35 is a plan view of a part of the latch assembly on the third mechanism in FIGS. 31-34.
Figure 36:
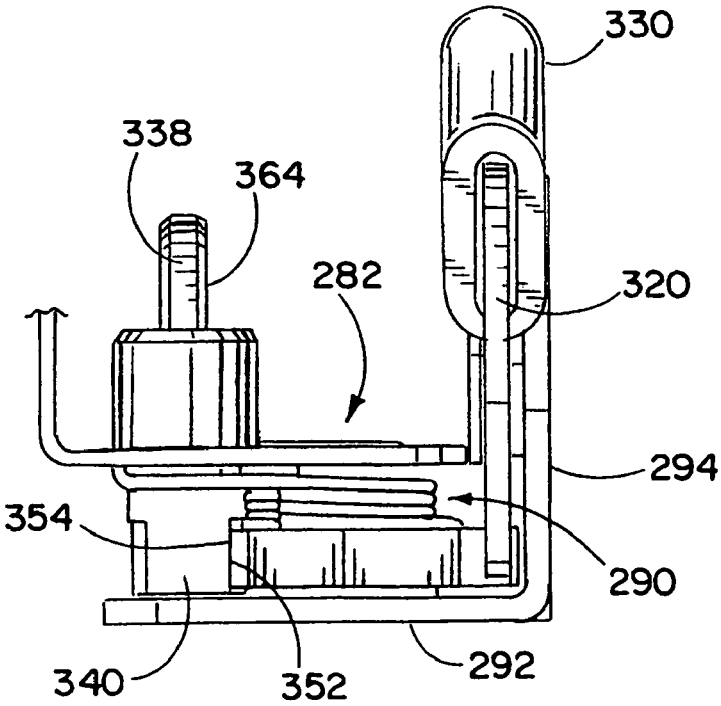
FIG. 36 is a side elevation view of the third mechanism in FIGS. 31-35.
Figure 37:
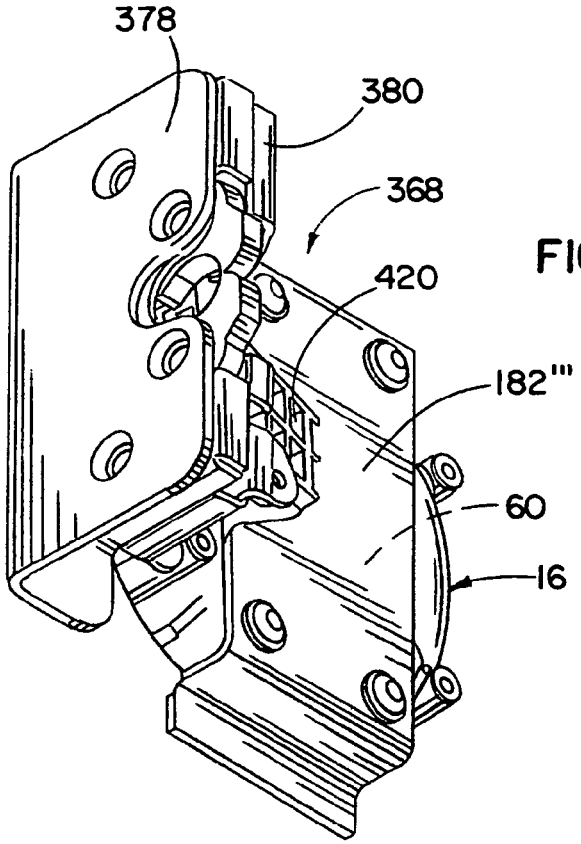
FIG. 37 is a rear, perspective view of a fourth mechanism operatively connected to the base assembly, with a latch assembly thereon in a latched state and having two release assemblies therefor, with a handle for operating one of the release assemblies renamed for clarity.
Figure 38:
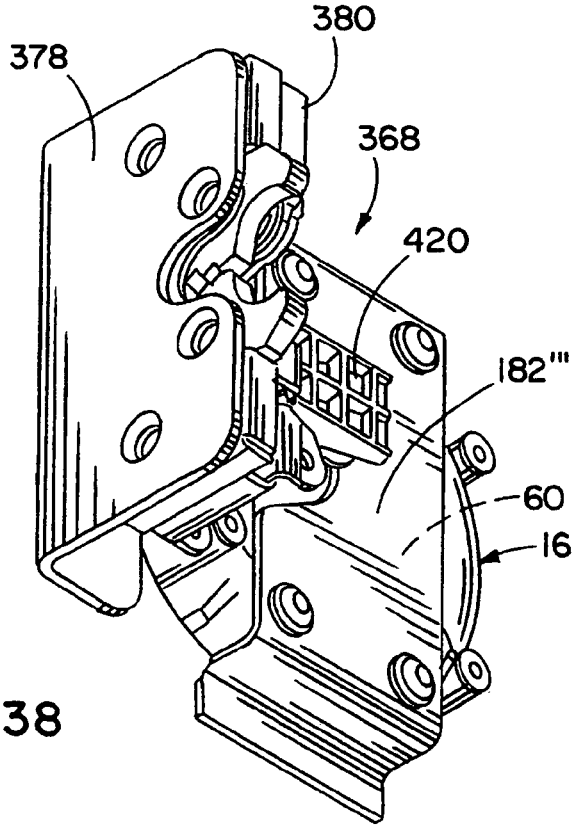
FIG. 38 is a view as in FIG. 37 wherein the latch assembly is in a release state.
Figure 39:
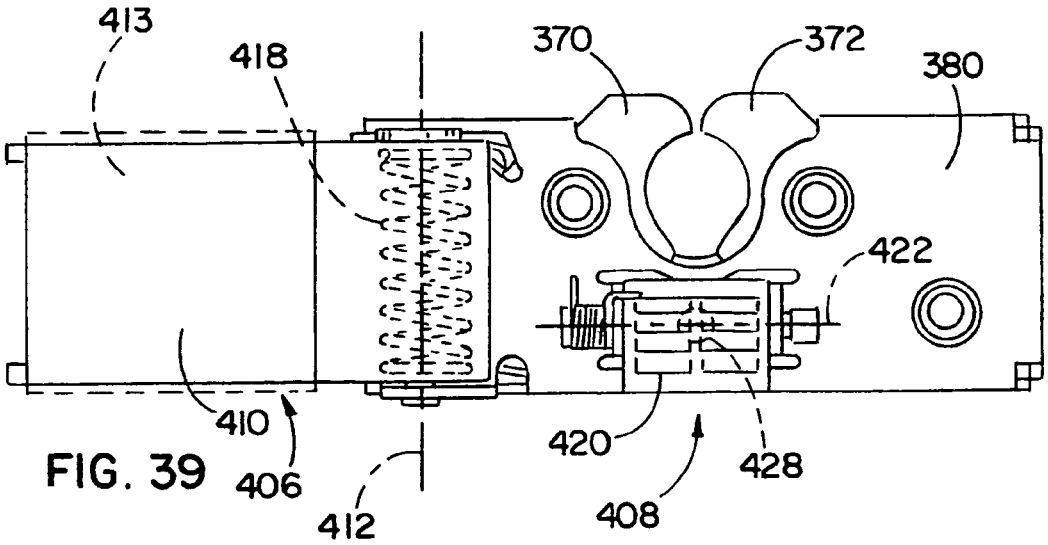
FIG. 39 is an enlarged, rear, elevation view of the latch assembly separated from the base assembly, in a latched state corresponding to that in FIG. 37, and with the release assembly handle, removed in FIGS. 37 and 38, installed.
Figure 40:
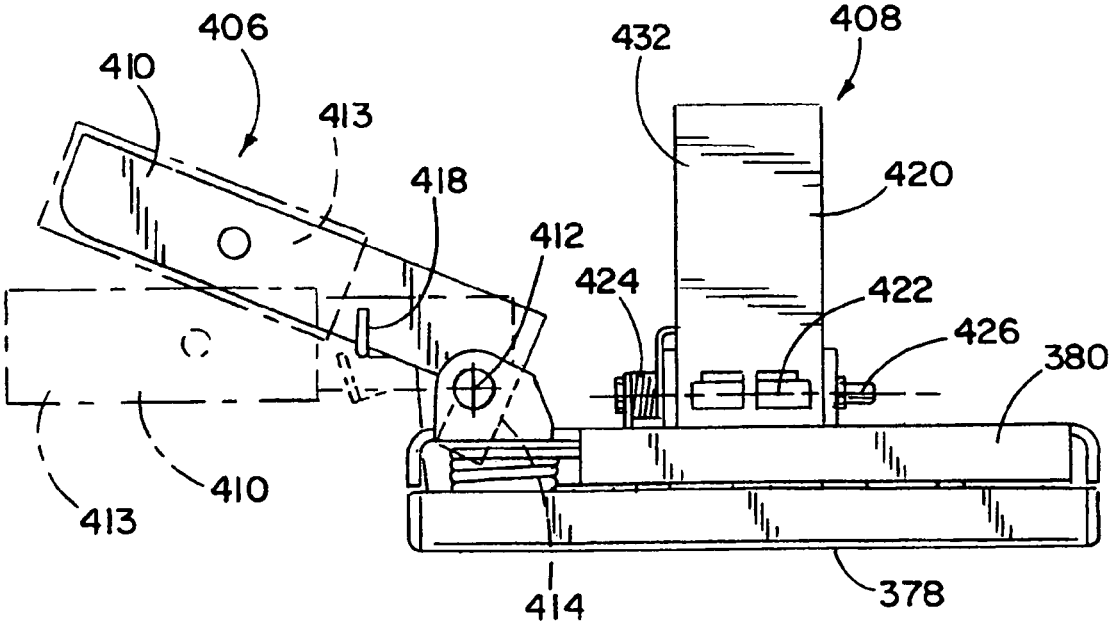
FIG. 40 is a side elevation view of the latch assembly in FIG. 39.

The catch 304 is guidingly movable around the axle 296 between an engaged position, shown in solid lines in FIG. 35, and a disengaged position, shown in dotted lines in that same Figure. Through a torsion spring 310, the catch 304 is normally biased towards its engaged position.

The rotor 300 and catch 304 operate in substantially the same manner as do the rotor 190 and catch 192, previously described. Likewise, the rotor 300 cooperates with the strike element 188 as does the rotor 190. More particularly, as the closure element 12 is moved towards the predetermined first position therefor, the strike element 188 engages the rotor 300 in its release position and urges it into its latched position, whereupon an operating arm 312 on the catch 304 blocks the rotor 300 in its latched position. By pivoting the catch 304 in the direction of the arrow 314 around the axis 306, from the solid line/engaged position into the dotted line/disengaged position, the rotor 300 is released from the latched position therefor to be moved under a force developed by the spring 308 into its release position.

The catch 304 is repositionable from the engaged position into one disengaged position, by either of two different release assemblies, shown at 316 and 318, for operation on opposite sides of the closure element 12.

The first release assembly 316 consists of a release lever 320 that is mounted to the wall 294 through a post/rivet 322 having an axis 324 about which the release lever 320 is pivotable. A separate post/rivet 326 extends through an elongate, arcuate slot 328 through the release lever 320 and into the wall 294 to thereby guide movement of the release lever 320 and establish the limits of pivoting travel thereof, as dictated by the angular extent of the slot 328.

The release lever 320 has a graspable handle 330 that can be manipulated to pivot the release lever 320 about the axis 324 in the direction of the arrow 332, thereby to cause a projection 334 thereon to engage an actuating arm 336 on the catch 304 to thereby pivot the catch 304 in the direction of the arrow 314 (FIG. 35) out of the engaged position to thereby release the rotor 300, which thereby pivots, under the force of the spring 310, from its latched position into its release position.

The release assembly 318 consists of an actuator element 338 with a post 340 that is guided in pivoting movement around an axis 342 relative to the housing walls 286, 292. More particularly, the post 340 has a stepped outer diameter with a smaller diameter portion 344 at its free end that is press-fit into a complementary bore 346 in the wall 292. A larger diameter portion 348 of the post 340 is guided in rotation within a bore 350 through the wall 286. The actuator element 338 is secured to the wall 286 by a C-clip 351.

The post 340 has a cut-out 352 defining a complementary receptacle for a second actuating arm 354 on the catch 304. The cut-out 352 is configured so that as the post 340 is pivoted in the direction of the arrow 356 around the axis 342, the post 340 cams the second actuating arm 354 in a manner that urges the catch 304 in the direction of the arrow 314 in FIG. 35 around the axis 306, to thereby change the catch 304 from the engaged position into the disengaged position therefor.

Pivoting movement of the post 340 is imparted by the actuating component/plunger 66 through the fastener 82. More particularly, the mounting plate 182" is mounted to the base assembly 16 using a second set of bores 258*a*, 258*b*, 258*c*, 258*d* (FIG. 13) that are different than the bores 236*a*, 236*b*, 236*c*, 236*d*, used to accommodate the mechanisms 18, 20, as previously described. The pattern of the bores 236*a-d* is angularly shifted 90° from the pattern of the bores 258*a-d*. The mounting plate 182" has bores 360*a*, 360*b*, 360*c*, 360*d* alignable one each with the bores 258*a*, 258*b*, 258*c*, 258*d*, to accept fasteners 361*a*, 361*b*, 361*c*, 361*d*.

Accordingly, with the two sets of pre-formed bores 236*a-c*, 258*a-d* available, the manufacturer/end user has the option of changing the orientation of each housing for each mechanism 18, 20, 282 by 90°.

With the mechanism 282 operatively interconnected with the base assembly 16, an opening 362 through the mounting wall 284 is located so as to allow the actuating component/plunger 66 to move therethrough as it is changed between its extended and retracted positions. By changing the actuating component/plunger 66 from the retracted position into the extended position, the fastener 82 thereon engages a surface 364 on an arm 366 that projects radially from the axis 342 at the top of the post 340. The contact location is spaced from the axis 342 so that the translating fastener 82 cams the arm 366 thereby to pivot the post 340 in the direction of the arrow 356 to thereby change the catch 304 from its engaged position into its disengaged position.

In FIGS. 37-49, a fourth exemplary mechanism is shown at 368 in modular form to be attached as a self-contained unit to the base assembly 16. The mechanism 368 has a mounting plate/housing part 182''' that is configured in a generally "U" shape to wrap around the back of the base assembly 16 and facially against the flat mounting surface 60 thereon. The mechanism 368 uses a pair of rotors 370, 372 that cooperate with the strike element 188 in conventional fashion. Whereas a single rotor 300 cooperates with a supporting structure therefor on the third mechanism 282, to capture the strike element 188, the rotors 370, 372 cooperate with each other on the mechanism 368 to perform this same captive function.

Figure 44:
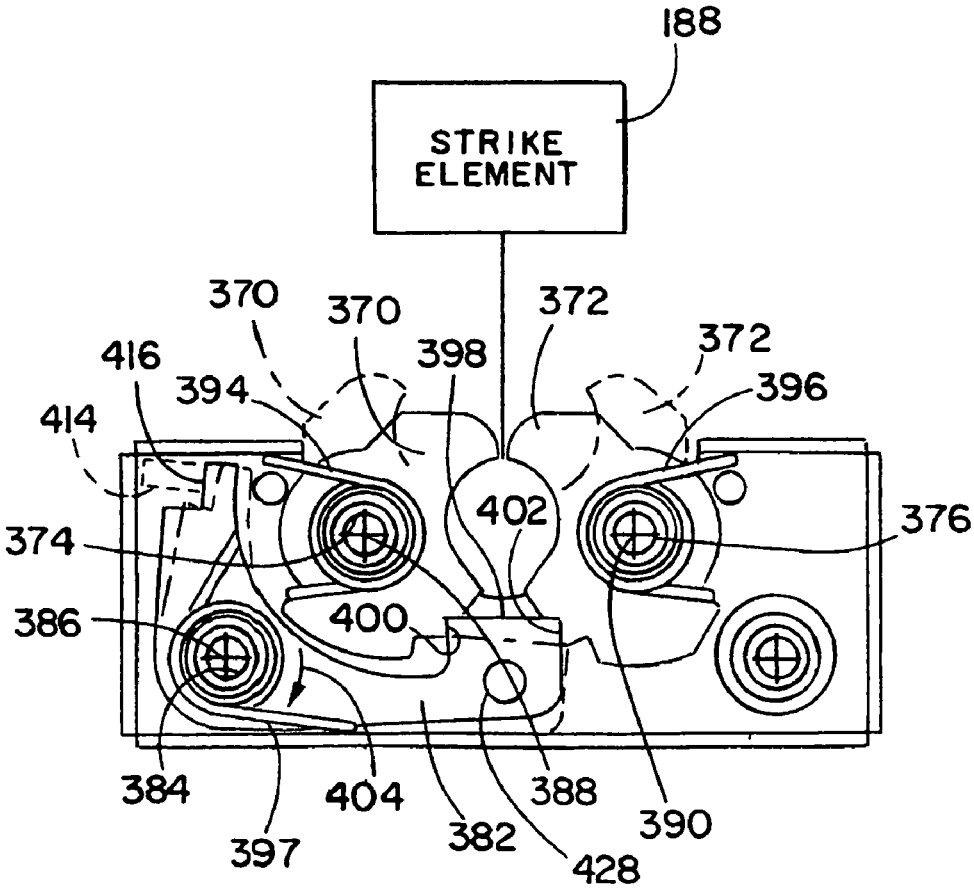
FIG. 44 is an elevation view of the part of the latch assembly and showing operating rotors and a catch in different cooperating positions.
Figure 45:
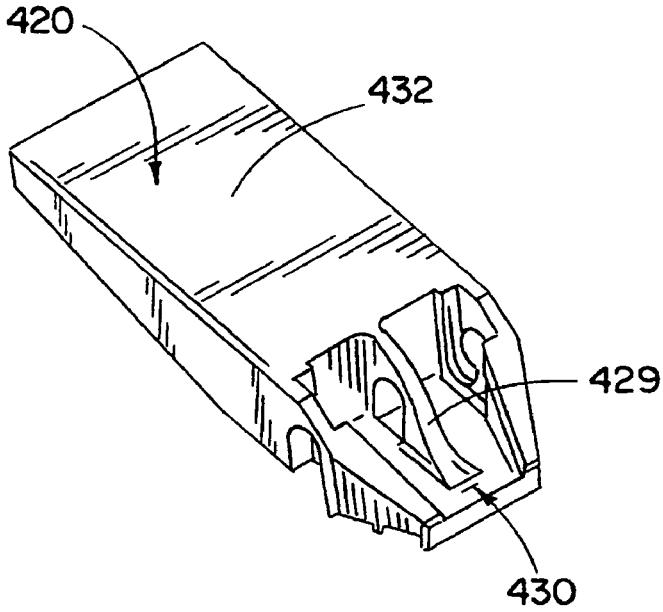
FIG. 45 is an enlarged, perspective view of a trip paddle on the fourth mechanism.
Figure 46:
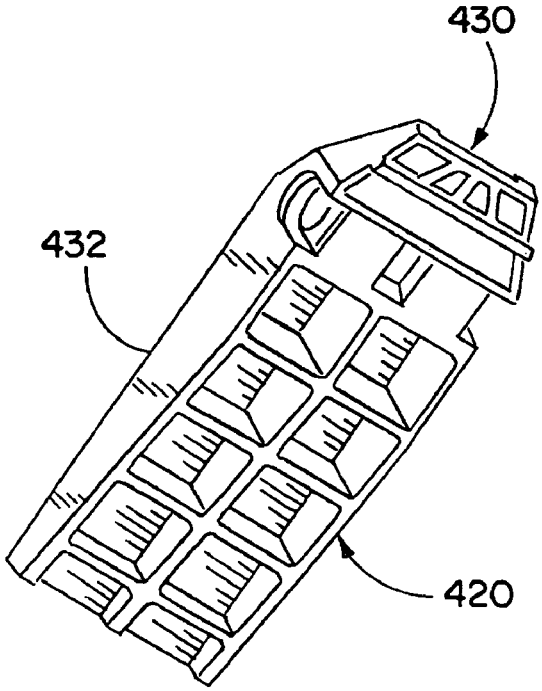
FIG. 46 is an enlarged, perspective view of the trip paddle from a different angle.
Figure 47:
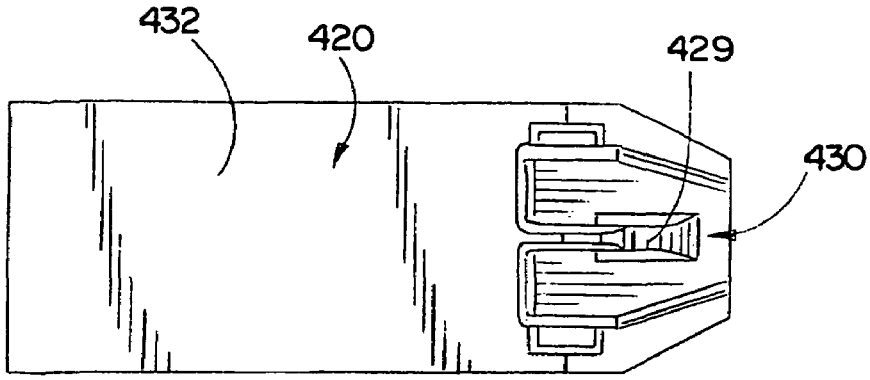
FIG. 47 is a perspective view of the trip paddle from a still further different angle.
Figure 48:
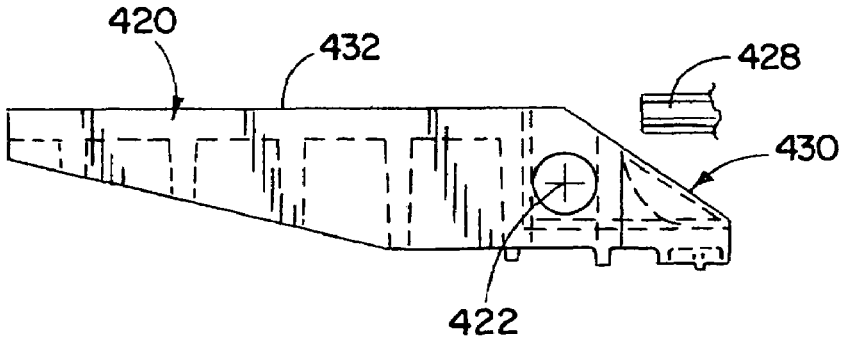
FIG. 48 is an enlarged, side elevation view of the trip paddle in FIGS. 45-47 in relationship to a post on a catch, that is engaged and moved by the trip paddle to thereby change the state of the latch assembly.
Figure 49:
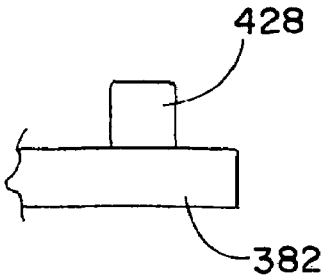
FIG. 49 is an enlarged, fragmentary, side elevation view of the catch and post that cooperate with the trip paddle, as shown in FIG. 48.

The rotors 370, 372 are journalled for pivoting movement around axles 374, 376, respectively, between latched positions, shown in solid lines in FIG. 44 and release positions, as shown in dotted lines in that same Figure. The axles 374, 376 connect joinable housing parts 378, 380, with the latter rigidly connected to the mounting plate 182''' to define a unitary housing structure.

A catch 382 is mounted on a separate axle 384 for pivoting movement around an axis 386 between an engaged position, as shown in solid lines in FIG. 44, and a disengaged position, as shown in dotted lines in that same Figure.

The rotors 370, 372 are pivotable relative to their respective axles 374, 376 around axes 388, 390, which are substantially parallel to each other and the axis 386, as the rotors 370, 372 move between the latched and release positions therefor. Through torsion coil springs 394, 396, the rotors 370, 372 are normally urged towards their release positions.

The catch 382 is pivotable around the axis 386 of the axle 384 between the engaged and disengaged positions therefor and is normally biased by a torsion coil spring 397 towards the engaged position. In the engaged position for the catch 382, a head 398 thereon resides between facing surfaces 400, 402 on the rotors 370, 372, respectively, to thereby block pivoting movement of the rotors 370, 372 under the force of the springs 394, 396 from their latched positions into their release positions. By pivoting the catch 382 around the axis 386 in the direction of the arrow 404, the head 398 is caused to be moved out of engagement with the surfaces 400, 402 and out of the path thereof as the rotors 370, 372 move from their latched positions into their release positions.

As the closure element 12 is moved toward the predetermined first position, the strike element 186 contacts both of the rotors 370, 372 in their release positions and urges them towards their latched positions, as an incident of which the catch head 398 pivots under the force of the spring 397 into the engaged position shown in solid lines in FIG. 44.

The catch 382 is changed between the engaged and disengaged positions therefor by either of two release assemblies 406, 408. The release assembly 406 consists of a pivotable handle 410 that is mounted to the housing part 380 for guided pivoting movement around an axis 412 between a normal position, as shown in solid lines in FIG. 40, and a release position, as shown in dotted lines in that same Figure. An optional graspable cover 413 is provided thereon. The handle 410 has a projection 414 that is engageable with an actuating arm 416 on the catch 382. As the handle 410 is pivoted between the solid line and dotted line positions in FIG. 40, the projection 414 cams the actuating arm 416 in a manner that the catch 382 is pivoted to the disengaged position. Through a torsion coil spring 418, the handle 410 is normally urged towards the solid line position in FIG. 40.

Figure 41:
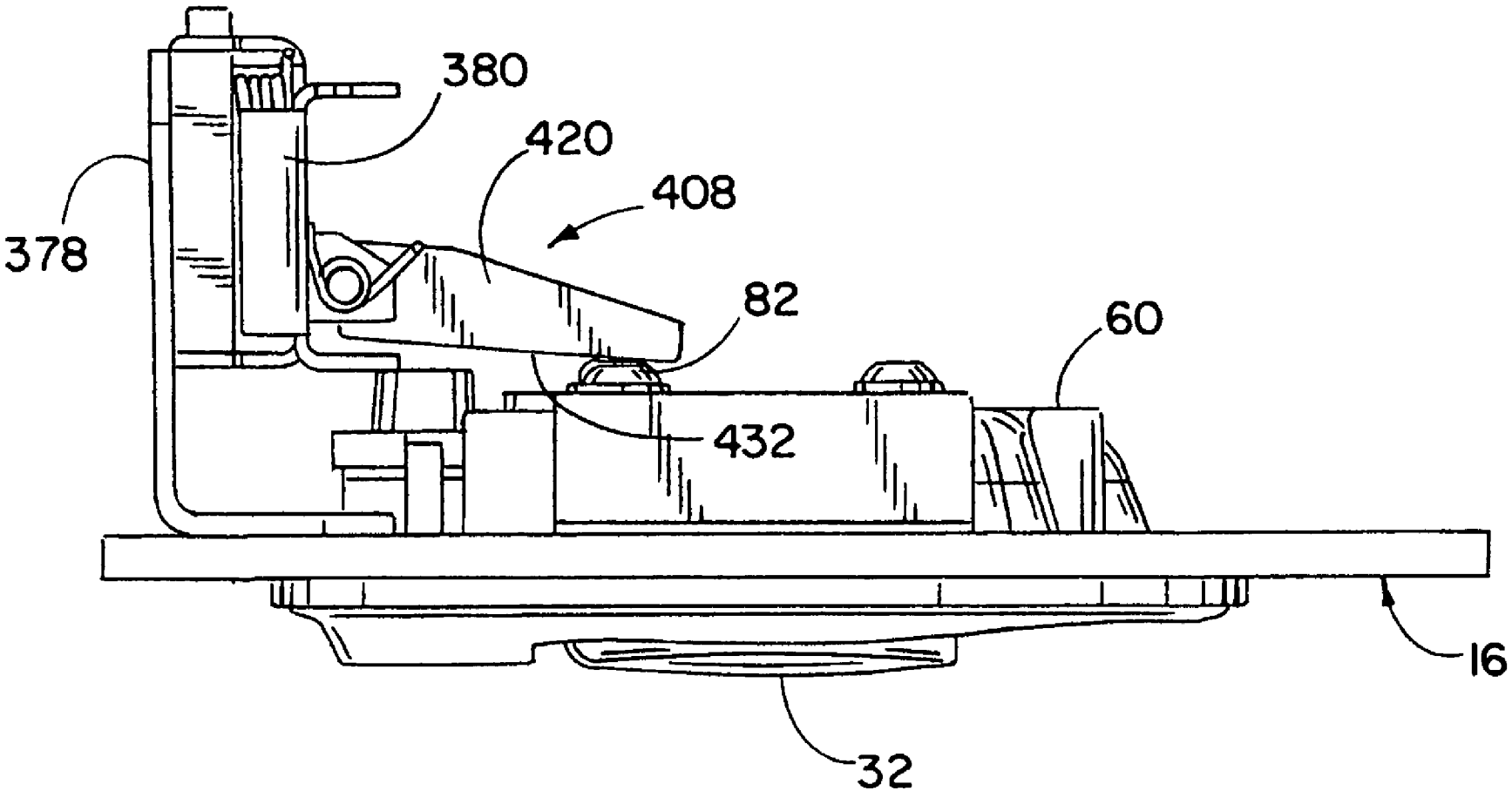
FIG. 41 is a side elevation view of the components in FIGS. 37 and 38 with the latch assembly thereon in a latched state as in FIG. 37 and the handle removed as in FIGS. 37 and 38.
Figure 42:
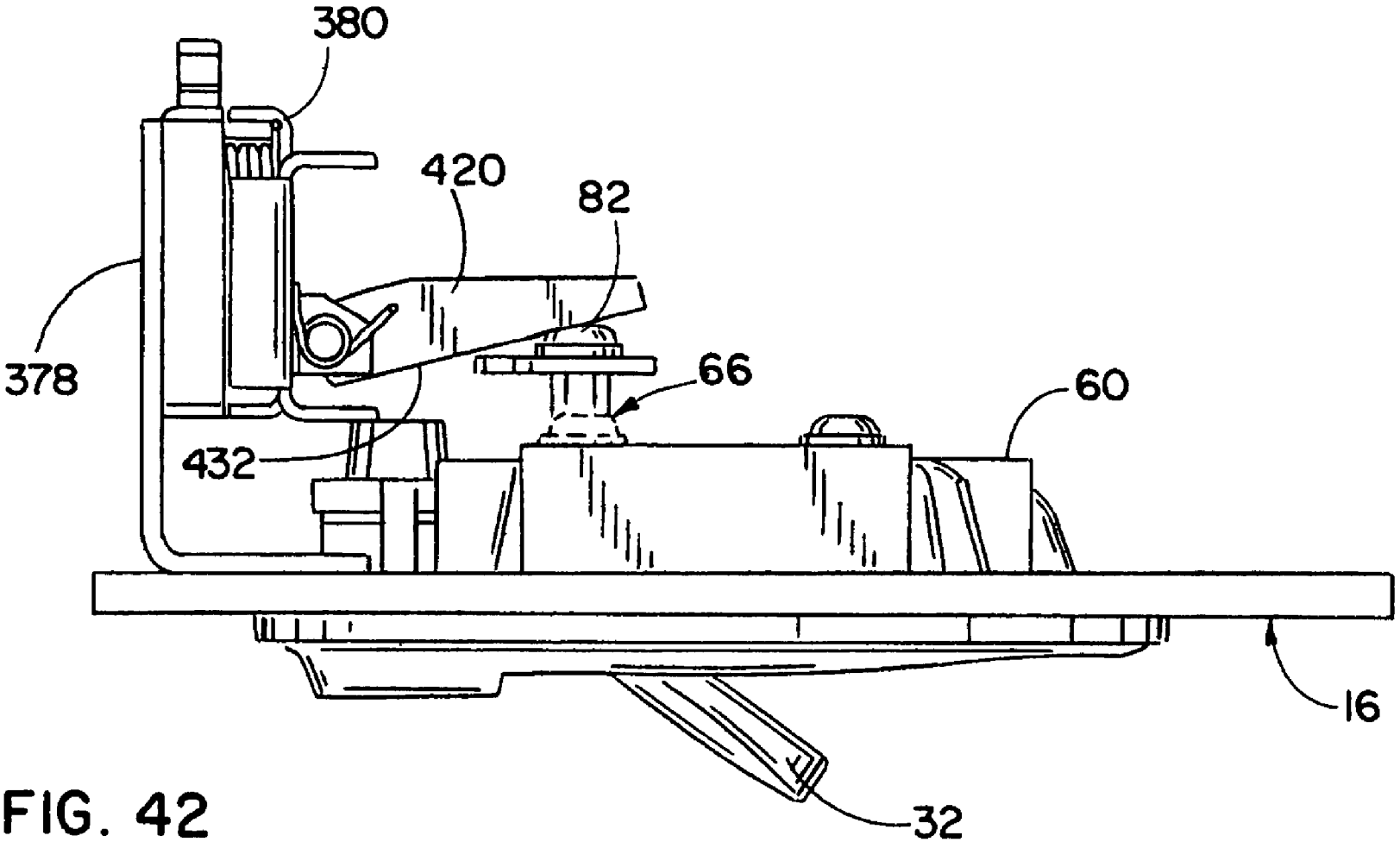
FIG. 42 is a view as in FIG. 41 wherein the operating handle is repositioned to change the latch assembly into its release state, as shown in FIG. 38.
Figure 43:
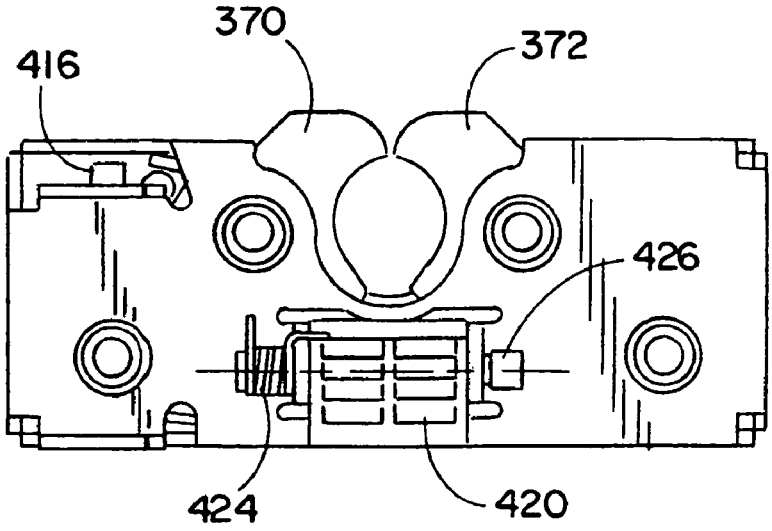
FIG. 43 is a view as in FIG. 39 with a part of the latch assembly removed.

The release assembly 408 consists of a trip paddle 420 that is guided in pivoting movement relative to the housing part 380 around an axis 422, that is orthogonal to the axis 412, between a normal position, shown in FIG. 41, and an actuated position, as shown in FIG. 42. The trip paddle 420 is biased towards the normal position therefor by a torsion coil spring 424 that wraps around a pin 426 that mounts the trip paddle 24 in guided pivoting movement relative to the housing part 380.

The trip paddle 420 is designed to cooperate with a post 428 projecting from the catch 382 in the vicinity of the head 398. As the trip paddle 420 is pivoted between the FIG. 41 and FIG. 42 positions, a curved surface 429 on an actuating portion 430 thereon engages the post 428 and, by repositioning the post 428, repositions the catch 382 between the engaged and disengaged positions therefor.

The trip paddle 420 has an actuating surface 432 that is contacted by the fastener 82 on the actuating component/plunger 66 as the actuating component/plunger 66 is changed between its retracted and extended positions. As this occurs, the fastener 82 produces a camming force against the surface 432 that pivots the trip paddle 420 from the FIG. 41 position into the FIG. 42 position, and thereby causes the catch 382 to be changed from its engaged position into its disengaged position.

Figure 50:
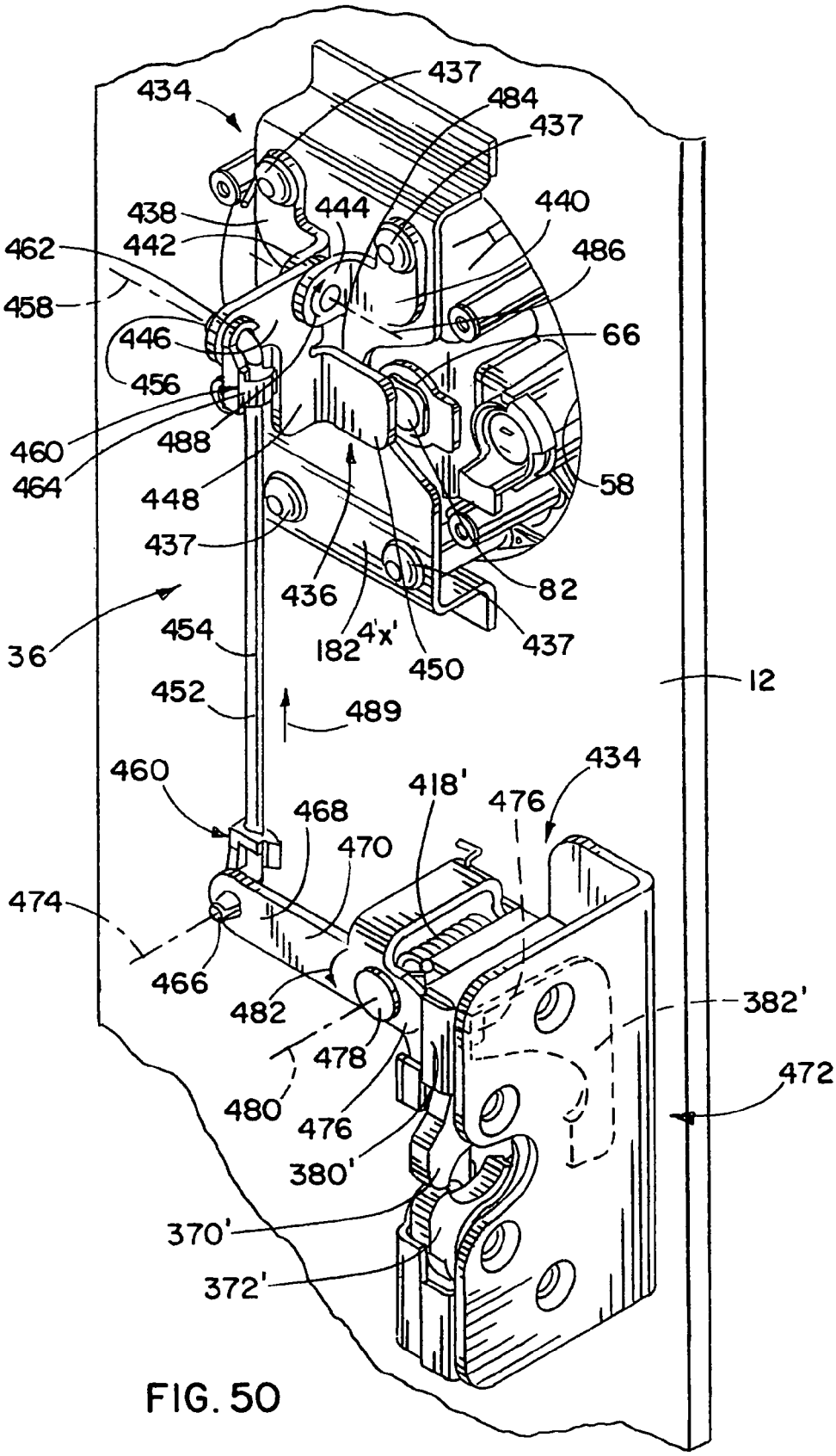
FIG. 50 is a fragmentary, rear elevation view of a closure element with a fifth mechanism, according to the present invention, operatively interconnected with the base assembly.
Figure 51:
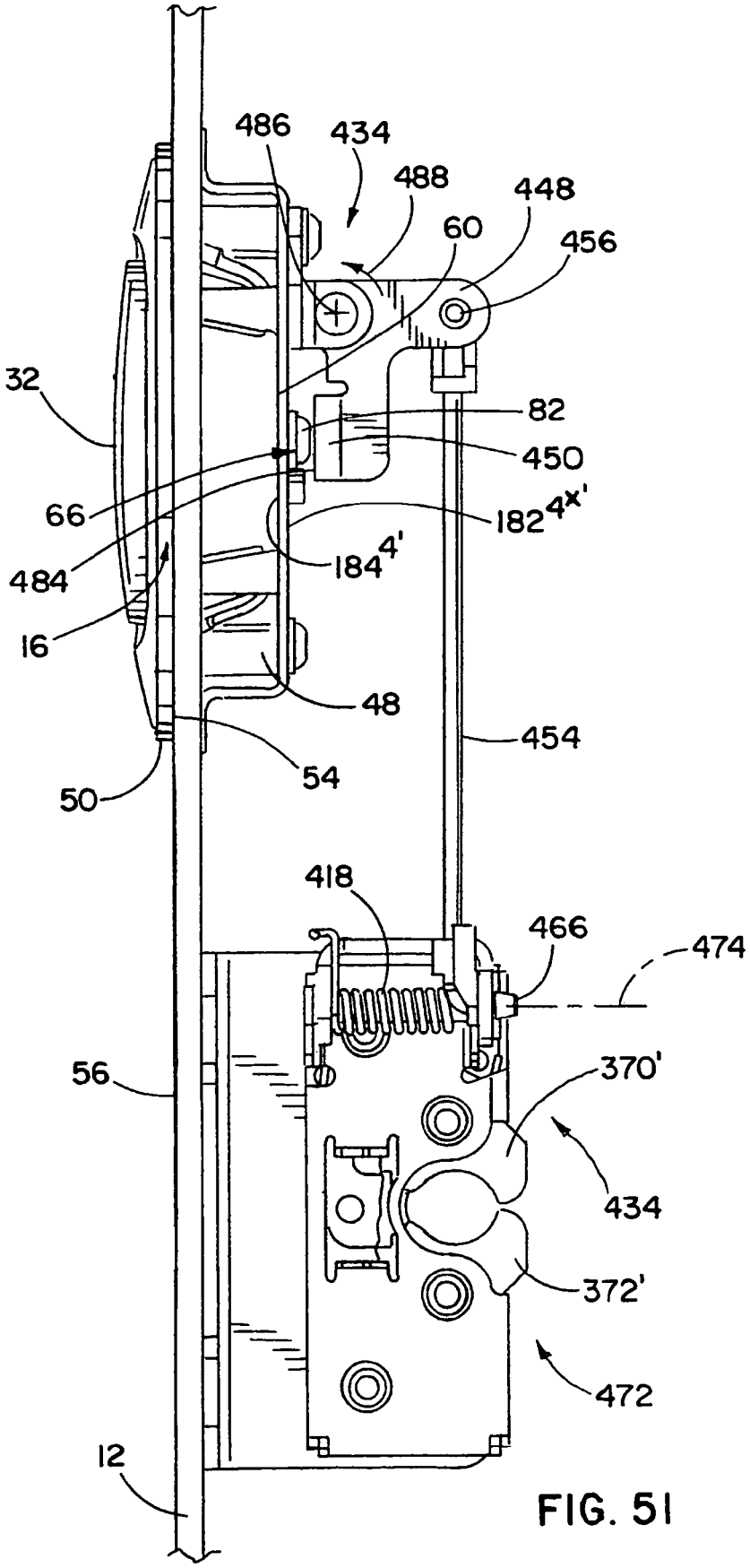
FIG. 51 is a side elevation view of the components in FIG. 50 with the trip paddle removed for clarity.
Figure 52:
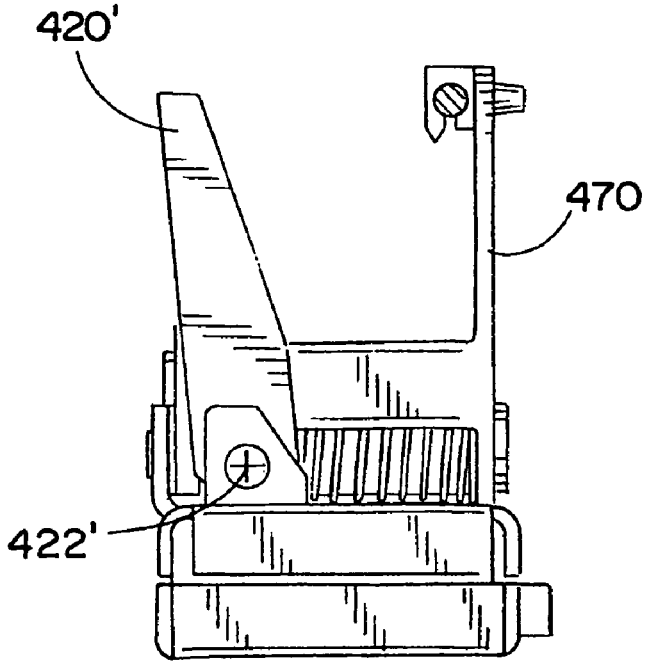
FIG. 52 is a side elevation of the latch assembly on the fifth mechanism in FIGS. 50 and 51.

A fifth mechanism, according to the present invention, is shown in FIGS. 50-52 at 434. The mechanism 434 corresponds to that shown in FIG. 8, including the linkage 36. The linkage 36 may be viewed as being separate from or a part of the overall mechanism 434.

A mounting plate/housing part 1824' has a flat mounting surface $184^{4x'}$ that bears against the mounting surface 60 on the body 48 of the base assembly 16. The mounting plate $182^{4x'}$ has a "U" shape to nominally conform to and wrap around the back of the body 48.

To the mounting plate $182^{4x'}$ a link end support 436 is secured using two of the same fasteners 437 that operably interconnect the mounting plate $182^{4x'}$ to the body 48 of the base assembly 16. The link end support 436 includes two spaced support pieces 438, 440, respectively with offset tabs 442, 444 between which a space is formed for mounting of an actuator component 446. The actuator component 446 has a flat body 448 with a transverse actuating tab 450.

A force transmission rod 452 has a body 454 with an end 456 bent at right angles to the length of the body 454 and directed through the body 448 for pivoting movement about an axis 458. A snap-fit connector 460, of conventional construction, maintains the end 456 in the operative pivoting position shown. More specifically, the connector 460 has a press fit bushing 462 with an integral, hinged clamp 464 that pivots to against the link body 454 and is snap-connected thereto. The bushing 462 is expanded by the inserted link end 456 SO as to be thereby maintained in place on the body 448.

The opposite link end 466 is similarly bent at a 90° angle to the length of the body 452, but orthogonally to the axis 458. The end 466 extends through an arm 468 on an actuator 470 associated with a latch assembly 472. A like connector 460 is used to maintain the link end 466 pivotably upon the arm 468 for movement around an axis 474. A bell crank configuration results.

The latch assembly 472 incorporates substantially the same operating components as shown on the fourth mechanism 468, including cooperating rotors 370', 372' and a trip paddle 420' movable around an axis 422'. The only significant difference between these structures is that, whereas the handle 410 has a configuration to facilitate manual operation thereof, the actuator 470 is designed to be operated remotely by forces transmitted through the link 452. The arm 468 has an extension 476 that bears upon the catch 382' to move the catch 382' out of an engaged position with respect to the rotors 370', 372'. The arm 470 is mounted to the housing part 380', through a pin 478, for movement around an axis 480 and is normally biased by a torsion, coil spring 418' in the direction of the arrow 482 therearound.

As the handle 32 is operated, the actuating component/plunger 66 is changed from the retracted position into the extended position, whereupon the fastener 82 bears upon a flat surface 484 on the actuating tab 450 to cause pivoting of the tab 450 and associated body 448 around a pivot axis 486 in the direction of the arrow 488. This in turn produces a force on the link 452 in the direction of the arrow 489 that causes the actuator 470 to pivot in a direction, opposite to that of the arrow 482, around the axis 480, thereby to reposition the catch 382' from the engaged position into the disengaged position, whereupon the rotors 370', 372' can pivot from their latched positions into their release positions.

With this and other embodiments, as described above, the body 48 of the base assembly 16 can be directed through an accommodating opening 58 in the closure element 12 to the point that the annular surface 54 on the flange 50 facially abuts the surface 56 of the closure element 12. The base assembly 16 can be angularly reoriented by guiding the surfaces 54, 56, one against the other. When the desired angular position is achieved, the mounting plate $182^{4x'}$ can be secured by any known means to captively embrace the closure element 12.

Figure 53:
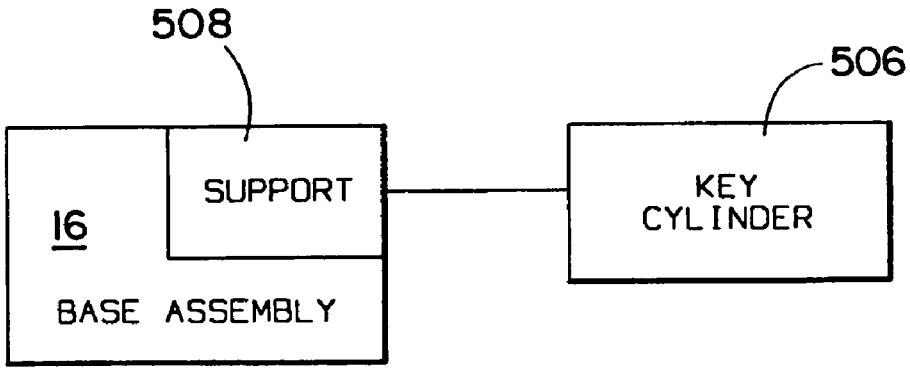
FIG. 53 is a schematic representation of a support on the base assembly to which interchangeable key cylinders on locking assemblies can be installed.
Figure 54:
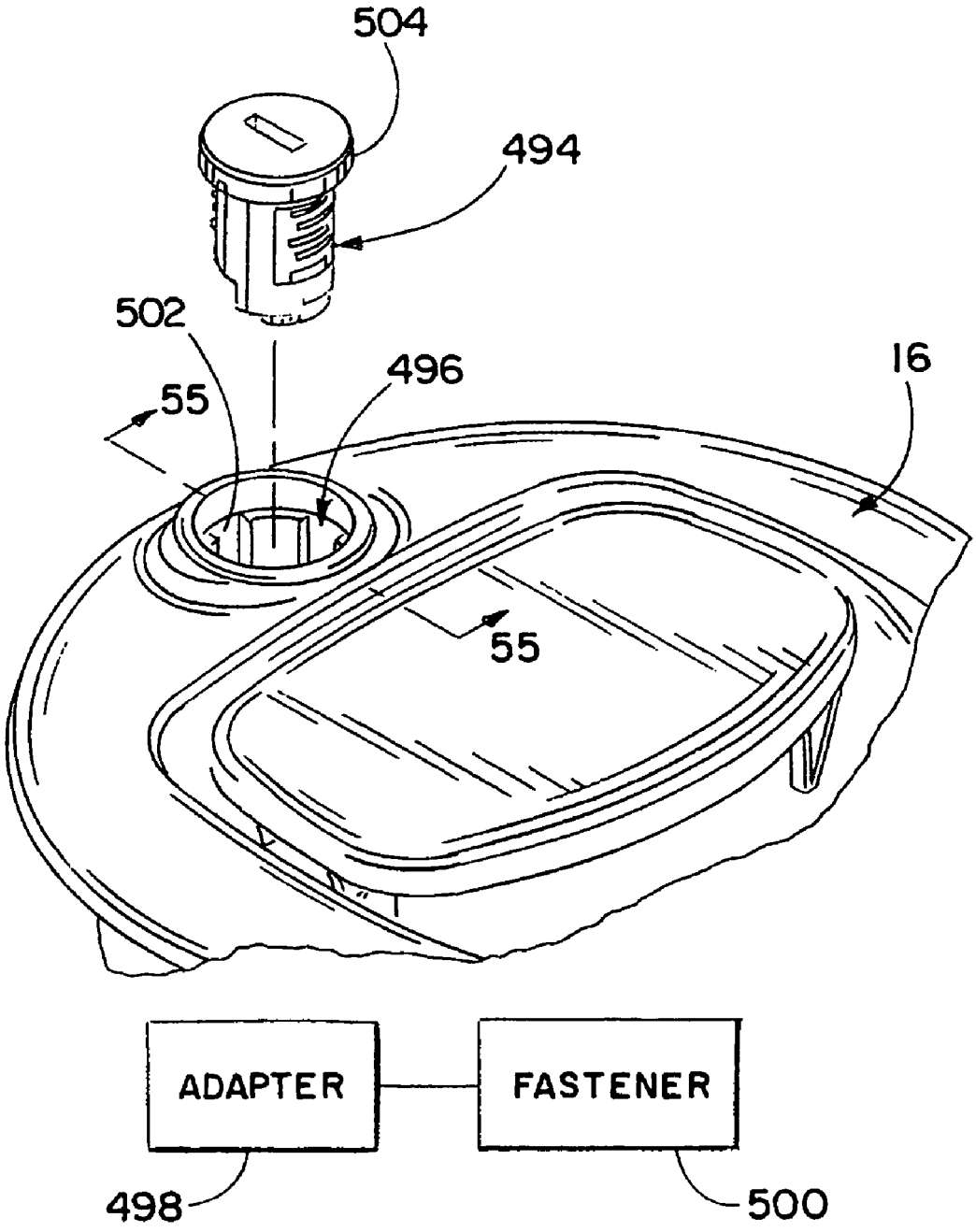
FIG. 54 is a fragmentary, partially schematic representation of the base assembly with one form of interchangeable key cylinder shown in exploded relationship thereto.
Figure 55:
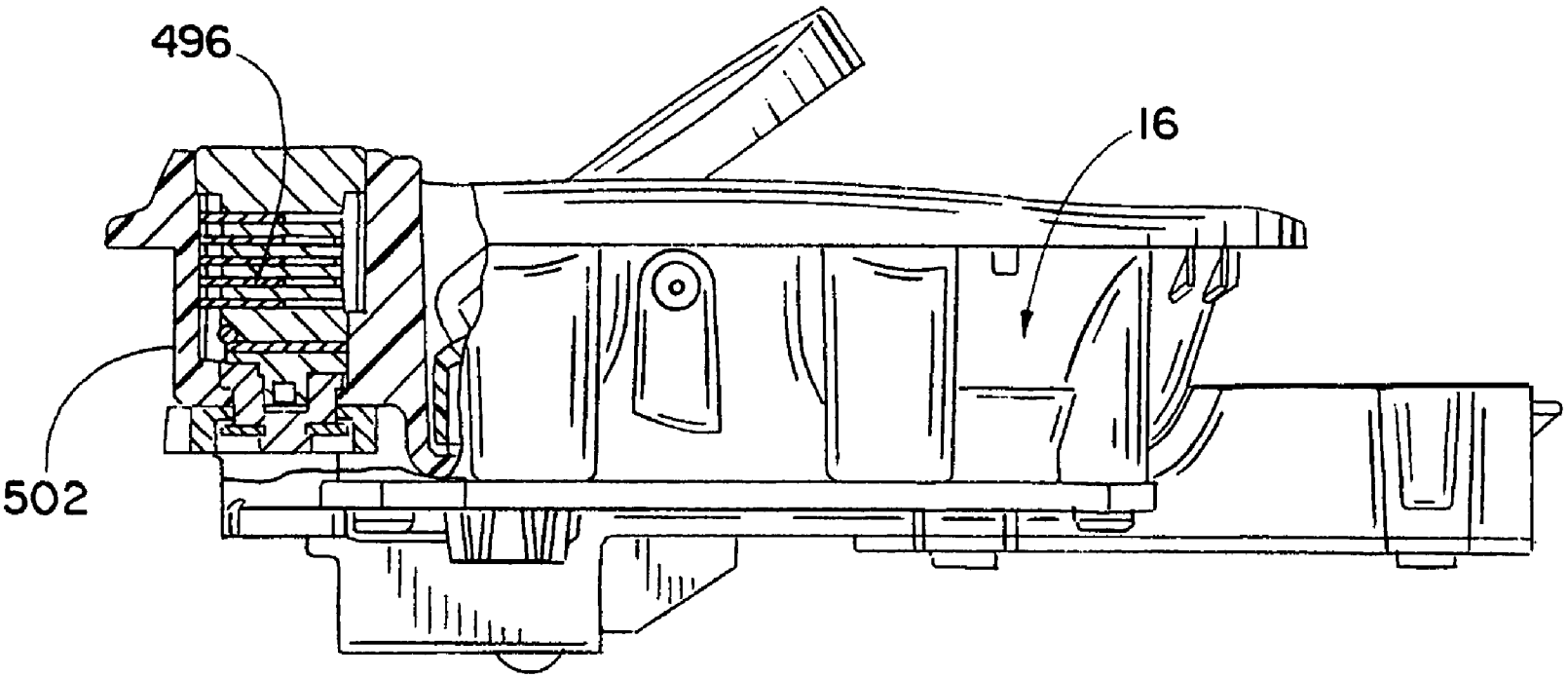
FIG. 55 is a side elevation view of the base assembly, shown partially in cross section taken along lines 55-55 of FIG. 54.

As shown in FIGS. 53-55, the invention also contemplates that a particular, selected, type of keyed locking cylinder 494 can be installed on different locking assemblies 38, 40, as shown schematically in FIG. 9. The key cylinder 506 can be installed from the front of the base assembly 16 in a receptive opening 496 to project therethrough for reception of a securing adaptor 498 that can be maintained in place by swaging an end, or through a separate fastener 500. A wall 502 on the base assembly 16 is thus captive between an enlarged end 504 of the key cylinder 494 and the adaptor 498.

The invention also contemplates use of any type of interchangeable key cylinders 506, as shown schematically in FIG. 53, that might be secured in an operative position upon a support 508, as through a special key or through other structure known to those skilled in the art, that might facilitate assembly simply through a press fit step, or otherwise. The key cylinders may be selected by reason of their basic structures and/or their keying capabilities.

The base assembly 16 is shown with a non-handed configuration. Thus, it is versatile in terms of how it might be used.

The base assembly 16, including the body 48, and other components, may be made from plastic or a composite to reduce the cost and weight thereof. However, it is contemplated that metal parts might be utilized.

Figure 56:
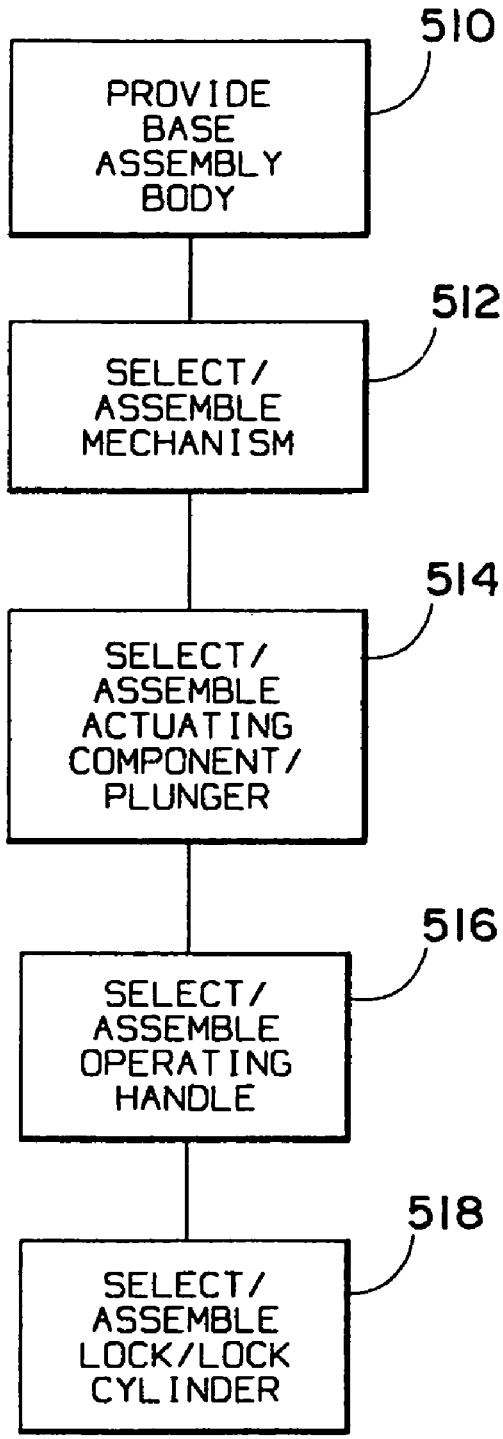
FIG. 56 is a schematic representation of a method of making a latch system, according to the present invention.

With the inventive structure, as shown in the various examples above, substantial flexibility is afforded to the manufacturer and/or end user in terms of designing an overall system. As shown schematically in FIG. 56, a base assembly body is provided, as shown at block 510. The user then selects the desired mechanism, as shown at block 512, depending upon the particular required function or application. The mechanism may be selected from those described above or may be a mechanism having another configuration that would be obvious to one skilled in the art with the inventive concepts in hand. The appropriate mechanism is thus assembled.

Depending upon the mechanism chosen, an actuating component/plunger suitable for that mechanism is selected and assembled, as shown at block 514.

As shown at block 516, the user selects the desired configuration for the operating handle and assembles the same to the base assembly body, as shown at block 516.

As shown at block 518, the desired lock or lock cylinder can be selected and assembled.

The manufacturer/end user thus has the flexibility to mix and match components starting with a common base assembly body. As noted above, the mechanisms can be mounted in different orientations using different sets of fastening bores on the base assembly body 48.

The foregoing disclosure of specific embodiments is intended to be illustrative of the broad concepts comprehended by the invention.

The invention claimed is:

1. A kit for selectively constructing a system for releasably maintaining a movable closure element in a latched position relative to a frame with a selected latching part upon which the closure element is movably mounted, the kit comprising:

a base assembly;

a first latching mechanism that is operably attachable to the base assembly to define in conjunction with the base assembly a first system having a first configuration that is operable in a first manner; and a second latching mechanism that is operably attachable to the base assembly to define in conjunction with the base assembly a second system having a second configuration that is operable in a second manner that is different than the first manner, the first and second latching mechanisms interchangeably operably attachable to the base assembly, one in place of the other, to allow a selection to be made by an assembler as to a desired configuration and manner of operation of a system, wherein the first and second latching mechanisms each has a first state, the first and second latching mechanisms in their first states engaging the selected latching part on the frame so as to releasably maintain the movable closure element in the latched position, the first and second latching mechanisms each having a second state wherein the first and second latching mechanisms are separable from the selected latching part on the frame so that the movable closure element is movable from the latched position into a release position, the kit further comprising at least one operating assembly, comprising at least one operating handle, and at least one actuating component, attachable to the base assembly so that a selected operating handle is movable relative to the base assembly between normal and release positions and a selected actuating component cooperates with the selected operating handle in a manner whereby the selected actuating component is moved as the selected operating handle is moved from its normal position into the release position as an incident of which the first and second latching mechanism that is selected and attached to the base assembly is changed from its first state into its second state, wherein the first latching mechanism comprises at least one rotor moved by the selected actuating component to pivot around an axis as the first latching mechanism is changed between its first and second states, the at least one rotor engageable with the selected latching part on the frame to releasably maintain the closure element in the latched state, wherein the second latching mechanism comprises a bolt that is moved by the selected actuating component in translation as the second latching mechanism is changed between its first and second states, the bolt engageable with the selected latching part on the frame to releasably maintain the closure element in the latched state.

2. The kit for selectively constructing a system according to claim 1 in combination with a movable closure element upon which the system is operably mounted and a frame to which the movable closure element is mounted for guided movement between the latched and release positions.

3. The kit for selectively constructing a system according to claim 2 wherein the at least one operating assembly comprises first and second operating assemblies respectively comprising first and second operating handles that are each graspable by a user and movable relative to the base assembly from a normal position to a release position to thereby change the respective first and second latching mechanisms from their first state into their second state, wherein the first and second handles have different configurations to be graspable in different manners to be repositioned by an operator from their normal into their release positions and are interchangeably operably attachable one in place of the other, to the base assembly.

4. The kit for selectively constructing a system according to claim 3 wherein the first and second operating handles are each pivotable about an axis between their normal and release positions.

5. The kit for selectively constructing a system according to claim 3 wherein the first handle comprises a graspable bail and the second handle comprises a flat, graspable paddle.

6. The kit for selectively constructing a system according to claim 3 wherein the base assembly has a non-handed configuration.

7. The kit for selectively constructing a system according to claim 2 wherein the selected latching part on the frame is selected from first and second latching parts having first and second configurations that may be the same or different in construction.

8. The kit for selectively constructing a system according to claim 7 wherein the first and second latching mechanisms respectively are in the form of first and second modules that are each selectively operably attachable, one in place of the other as a unit, directly to the base assembly.

9. The kit for selectively constructing a system according to claim 8 wherein the base assembly has a substantially flat mounting surface, the first latching mechanism has a first mounting plate with a first flat surface that is placed facially against the flat mounting surface with the first latching mechanism operably attached to the base assembly, and the second latching mechanism has a second mounting plate with a second flat surface that is placed facially against the flat mounting surface with the second latching mechanism operably attached to the base assembly.

10. The kit for selectively constructing a system according to claim 9 wherein the base assembly comprises a cup-shaped housing with a front and back and the flat mounting surface is at the back of the cup-shaped housing, the cup-shaped housing has pre-formed bores, the first mounting plate has pre-formed bores aligned with the pre-formed bores in the cup-shaped housing to receive fasteners that maintain the first latching mechanism operably attached to the base assembly, and the second mounting plate has pre-formed bores aligned with pre-formed bores in the cup-shaped housing to receive fasteners and maintain the second latching mechanism operably attached to the base assembly.

11. The kit for selectively constructing a system according to claim 7 wherein there is a single actuating component that is part of the base assembly and is translated from a retracted position into an extended position to thereby change each of the first and second latching mechanisms that is attached to the base assembly from its first state into its second state.

12. The kit for selectively constructing a system according to claim 11 wherein the first latching mechanism comprises a pivoting operating arm that is repositionable by the single actuating component as the single actuating component is changed from the retracted position into the extended position to thereby cause the at least one rotor to pivot around the axis, and the single actuating component engages the bolt and cams the bolt so as to move the bolt along the line as the single actuating component is changed from the retracted position into the extended position.

13. The kit for selectively constructing a system according to claim 11 wherein the base assembly has a front and back and the single actuating component is translated between the retracted and extended positions in a front-to-back/back-to-front direction.

14. The kit for selectively constructing a system according to claim 7 wherein the first latching mechanism comprises a housing remote from the base assembly upon which the at least one rotor is mounted and there is a linkage connecting between the base assembly and remote housing.

15. The kit for selectively constructing a system according to claim 14 wherein the first latching mechanism comprises a first mounting plate having pre-formed bores that are alignable with a first set of pre-formed bores in the base assembly to accept fasteners that maintain the first latching mechanism operably attached to the base assembly.

16. The kit for selectively constructing a system according to claim 15 wherein the second latching mechanism comprises a second mounting plate having pre-formed bores that are alignable with a second set of pre-formed bores in the base assembly that is different than the first set of pre-formed bores to accept fasteners that maintain the second latching mechanism operably attached to the base assembly.

17. The kit for selectively constructing a system according to claim 14 wherein the linkage comprises a bell crank between the base assembly and the remote housing.

18. The kit for selectively constructing a system according to claim 2 wherein the base assembly comprises a non-metal material.

19. The kit for selectively constructing a system according to claim 18 wherein the base assembly comprises a cup-shaped housing with a front and back, the housing comprising a body with a periphery having an effective diameter and an outturned flange on the body defining a rearwardly facing mounting surface, the base assembly and first or second latching mechanism that is operably attached to the base assembly movable as a unit from a fully separated state through a mounting opening in the movable closure element to place the rearwardly facing mounting surface facially against a surface on the movable closure element.

20. The kit for selectively constructing a system according to claim 19 wherein the unit can be moved by guiding the rearwardly facing mounting surface against the surface on the movable closure element to thereby change an angular orientation of the unit relative to the movable closure element.

21. The kit for selectively constructing a system according to claim 19 wherein the outturned flange has a peripheral outer edge that is substantially round.

22. The kit for selectively constructing a system according to claim 2 further in combination with a plurality of different, keyed locking cylinders that can be selectively installed on the base assembly, one in place of the other, to selectively prevent operation of the first and second mechanisms.

23. A method of constructing a system for releasably maintaining a movable closure element in a latched position relative to a frame with a selected part upon which the closure element is movably mounted, the method comprising the steps of:

providing a base assembly;

providing a plurality of components that can be interchangeably mounted on the base assembly and comprising a plurality of latching mechanisms that are selectively operably attachable, one in place of the other, to respectively define, in conjunction with the base assembly, first and second systems that are operable in different manners by an operator to releasably engage a selected latching part on the frame thereby to releasably maintain a closure element upon which the first and second systems are provided in the latched position, wherein the step of providing a plurality of components comprises providing:

a) at least one operating handle that is attachable movably to the base assembly;

b) at least one actuating component that is moved by the selected operating handle;

c) a first latching mechanism comprising a first module with at least one pivotable rotor that is releasably engageable with a selected latching part on the frame to maintain its movable closure element in the latched position and operable through movement of the at least one actuating component as an incident of the handle being moved relative to the base assembly; and d) a second latching mechanism comprising a second module with a bolt that is translatable substantially along a line and releasably engageable with a selected latching part on the frame to releasably maintain the movable closure element in the latched position and operable through movement of the at least one actuating component as an incident of the handle being moved relative to the base assembly; and selectively operatively connecting together the base assembly, at least one actuating component, one operating handle, and a selected one of the first and second latching mechanisms depending upon a type of latching operation that is desired.

24. A method of constructing a system according to claim 23 wherein the step of providing at least one handle comprises providing a first handle that is pivotable relative to the base assembly and graspable in a first manner, and providing a second handle that is pivotable relative to the base assembly and graspable in a second manner that is different than the first manner, the first and second handles selectively operatively connected to the base assembly, one in place of the other.

25. A method of constructing a system according to claim 23 further comprising the step of operably attaching the first module to the base assembly using a plurality of fasteners directed into a first set of pre-formed bores in the base assembly.

26. A method of constructing a system according to claim 25 further comprising the step of operably attaching the second module to the base assembly in place of the first module using a plurality of fasteners directed into a second set of pre-formed bores in the base assembly that is different than the first set of pre-formed bores in the base assembly.

27. A method of constructing a system according to claim 23 wherein the step of providing a plurality of components comprises providing the first latching mechanism with a housing remote from the base assembly with at least one pivotable rotor that is engageable with a part on a frame upon which the movable closure element is mounted and a linkage between the housing and the base assembly.

28. A method of constructing a system according to claim 27 wherein the step of providing a linkage comprises providing a linkage comprising a bell crank.

29. A method of constructing a system according to claim 23 wherein the step of providing a plurality of components comprises providing a plurality of different keyed lock cylinders and selectively installing one of the keyed lock cylinders on the base assembly.

30. A method of constructing a system according to claim 23 wherein the step of providing a base assembly comprises providing a base assembly with a cup-shaped housing.

31. A method of constructing a system according to claim 30 wherein the step of providing at least one actuating component comprises providing a single actuating component that directly interacts with each of the first and second latching mechanisms that is selected and operatively connected.

32. A method of constructing a system according to claim 31 wherein the step of providing at least one actuating component comprises providing a single actuating component that is translated by the at least one operating handle to operate each of the first and second latching mechanisms that is selected and operatively connected.

33. A method of constructing a system according to claim 23 further comprising the steps of providing a movable closure element and operably mounting the base assembly and one of the first and second mechanisms as a unit to the movable closure element.

34. A method of constructing a system according to claim 33 wherein the step of operably mounting the unit to the movable closure element comprises moving the unit guidingly against the movable closure element to change an angular relationship between the unit and the movable closure element.

35. A method of constructing a system according to claim 23 wherein the step of providing at least one actuating component comprises providing at least one actuating component that is translated by the at least one operating handle.

* * * * *

UNITED STATES PATENT AND TRADEMARK OFFICE

CERTIFICATE OF CORRECTION

PATENT NO. : 7,611,173 B2
APPLICATION NO. : 11/488485
DATED : November 3, 2009
INVENTOR(S) : Helton et al.

It is certified that error appears in the above-identified patent and that said Letters Patent is hereby corrected as shown below:

Column 19, line 12, after "attachable" insert --in the same manner--.

Column 21, line 57, after "mounted" insert --in the same manner--.

Column 22, line 14, delete "a" and insert --the-- therefor.

Signed and Sealed this

Twenty-third Day of February, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,611,173 B2
APPLICATION NO. : 11/488485
DATED : November 3, 2009
INVENTOR(S) : Helton et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 431 days.

Signed and Sealed this

Fourteenth Day of December, 2010

David J. Kappos

David J. Kappos
*Director of the United States Patent and Trademark Office*